US009085149B2

(12) United States Patent
Hagiwara et al.

(10) Patent No.: US 9,085,149 B2
(45) **Date of Patent: *Jul. 21, 2015**

(54) LIQUID EJECTING HEAD UNIT AND LIQUID EJECTING APPARATUS

(75) Inventors: Hiroyuki Hagiwara, Matsumoto (JP); Masayuki Eguchi, Matsumoto (JP); Kimiyasu Otsuki, Azumino (JP); Masanori Mochizuki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 218 days.

This patent is subject to a terminal disclaimer.

(21) Appl. No.: 13/212,130

(22) Filed: Aug. 17, 2011

(65) Prior Publication Data

US 2012/0044307 A1 Feb. 23, 2012

(30) Foreign Application Priority Data

Aug. 18, 2010 (JP) ..... 2010-182703

(51) Int. Cl.

| | |
|---|---|
| ***B41J 2/01*** | (2006.01) |
| ***B41J 2/15*** | (2006.01) |
| ***B41J 2/175*** | (2006.01) |
| ***B41J 29/02*** | (2006.01) |

(52) U.S. Cl.

CPC .. *B41J 2/15* (2013.01); *B41J 2/175* (2013.01); *B41J 2/1752* (2013.01); *B41J 29/02* (2013.01); *B41J 2202/14* (2013.01); *B41J 2202/19* (2013.01); *B41J 2202/20* (2013.01)

(58) Field of Classification Search

CPC ..... B41J 2/01; B41J 2/0057; B41J 2/17593; B41J 29/17; B41J 2002/012; B41J 2202/14; B41J 2202/19; B41J 2202/20

USPC ..... 347/12, 13, 20, 40, 43, 84, 85, 87; 156/356, 378

See application file for complete search history.

(56) References Cited

U.S. PATENT DOCUMENTS

| | | | | |
|---|---|---|---|---|
| 4,730,197 | A | 3/1988 | Raman | |
| 6,575,557 | B2 * | 6/2003 | Tominaga | 347/37 |
| 6,604,817 | B2 | 8/2003 | Isono | |
| 7,648,215 | B2 * | 1/2010 | Song et al. | 347/8 |
| 7,918,529 | B2 * | 4/2011 | Mitsuzawa | 347/20 |
| 7,980,645 | B2 * | 7/2011 | Ohtsuka et al. | 347/8 |

(Continued)

FOREIGN PATENT DOCUMENTS

| | | |
|---|---|---|
| JP | 2007-090327 | 4/2007 |
| JP | 2007-144734 | 6/2007 |

(Continued)

*Primary Examiner* — Manish S Shah
*Assistant Examiner* — Jeremy Delozier
(74) *Attorney, Agent, or Firm* — Workman Nydegger

(57) ABSTRACT

A flange portion is provided with two abutting protrusions, a spacer is formed with two abutting projections, the respective abutting protrusions and the abutting projections are formed on the outside of a tightening point tightened by a tightening member (a spacer fixing bolt and a spacer fixing nut) in the width direction orthogonal to an imaginary line connecting the tightening points of the flange portions on both sides, and a gap G is formed between the flange portion and the spacer at the tightening point (an opening limb portion of a spacer mounting hole and an insertion hole limb portion of a head insertion hole) before being tightened by the tightening member, while the flange portion and the spacer come into abutment with each other at the tightening point after having tightened in a state in which the abutting protrusions and the abutting protrusions come into abutment with each other.

7 Claims, 19 Drawing Sheets

(56) References Cited

U.S. PATENT DOCUMENTS

| | | | | |
|---|---|---|---|---|
| 8,016,383 | B2 * | 9/2011 | Mizutani et al. | 347/40 |
| 2003/0085943 | A1 | 5/2003 | Nakamura et al. | |
| 2010/0007699 | A1 | 1/2010 | Watanabe et al. | |
| 2010/0188461 | A1 * | 7/2010 | Hagiwara et al. | 347/44 |
| 2010/0225694 | A1 * | 9/2010 | Suzuki | 347/14 |
| 2012/0092415 | A1 * | 4/2012 | Hagiwara et al. | 347/44 |

FOREIGN PATENT DOCUMENTS

| | | |
|---|---|---|
| JP | 2009-137246 | 6/2009 |
| JP | 2010-30297 | 2/2010 |
| JP | 2010-105355 | 5/2010 |

* cited by examiner

LIQUID EJECTING HEAD UNIT AND LIQUID EJECTING APPARATUS

The entire disclosure of Japanese Patent Application No: 2010-182703, filed Aug. 18, 2010 is expressly incorporated by reference herein.

BACKGROUND

1. Technical Field

The present invention relates to a liquid ejecting head unit used in a liquid ejecting apparatus such as an ink jet recording apparatus and a liquid ejecting apparatus and, more specifically, to a liquid ejecting head unit which allows a liquid ejecting head to be mounted with high degree of positional accuracy with respect to a head fixing member and a liquid ejecting apparatus.

2. Related Art

A liquid ejecting apparatus includes a liquid ejecting head which is capable of ejecting liquid in the form of liquid droplets, and is an apparatus configured to eject various types of liquid from the liquid ejecting head. As a representative example of the liquid ejecting apparatus, for example, an image recording apparatus such as an ink jet recording apparatus (printer) provided with an ink jet recording head (hereinafter, referred to as "recording head") and configured to perform recording by ejecting liquid state ink from nozzles of the recording head in the form of ink droplets may be exemplified. In recent years, not only the image recording apparatus, the liquid ejecting apparatus is also applicable to various manufacturing apparatuses such as a display manufacturing apparatus.

In recent years, as the printer as described above, there is a type employing a configuration (multiple head type) in which a plurality of recording heads each having a nozzle row made up of a plurality of nozzles arranged in a row and being arranged on and fixed to a head fixing member such as a sub carriage are unified as a single head unit. Then, in a configuration in which the respective recording heads are screwed to the sub carriage in a state of being positioned in place, provisional fixation securing of the recording heads to the sub carriage with adhesive agent (for example, instant adhesive) after positioning and before screwing is performed. Accordingly, displacement of the position of the recording heads at the time of real fixation by screwing due to angular moment generating when screwing is prevented. When employing the provisional fixation using the adhesive agent as described above, it is difficult to remove the recording head once fixed to the sub carriage for repair or replacement. In order to cope with such a problem, a configuration in which an intermediate member referred to as a spacer is interposed between the recording heads and the sub carriage is also proposed (for example, JP-A-2007-90327). In this configuration, the spacer is fixed to the recording head by screwing in advance, and the spacer and the sub carriage are provisionally fixed with the adhesive agent, and then the spacer and the sub carriage are really fixed by screwing, so that the recording head fixed once to the sub carriage can be removed from the spacer and the sub carriage by releasing tightening of the screw with respect to the spacer. Accordingly, mounting and demounting of the recording head for replacement, repair, or the like of the recording head is facilitated.

Incidentally, in the configuration in which the spacer is fixed to the recording head by screwing, deformation of the spacer or a spacer mounting portion of the recording head when the screw is tightened is prevented by bringing the both into abutment with each other without a gap at a point of screwing in a state before tightening the screw. Accordingly, since the shape of the spacer or the spacer mounting portion is stabilized, deformation of the spacer or the like when the screw is tightened is restrained even when screwing the spacer with respect to the sub carriage, so that the positional displacement of the recording head caused by the deformation is prevented. In contrast, when the contact surface between the recording head and the spacer is small due to downsizing of the recording head or the spacer, the recording head tends to incline with respect to the sub carriage specifically in the direction orthogonal to an imaginary line connecting the screw tightening points between the recording head and the spacer. For example, in the multiple head printer described above, the shape of the recording head is set to be short in the dimension in the direction of side-by-side arrangement of the heads on the sub carriage (the direction orthogonal to the nozzle row direction) and to be long in the dimension in the direction orthogonal to the direction of side-by-side arrangement of the heads (the direction orthogonal to the nozzle row direction) from the view point of minimizing the size of the head unit. Then, the respective recording heads are fixed to the spacer or the sub carriage on both sides in a long side direction (flange portions). With the recording head in this configuration, the direction orthogonal to the imaginary line connecting the tightening points with respect to each other corresponds to a short side direction, and hence the inclination tends to occur in this direction.

Cases which may cause the inclination described above include a case where an external force acts on the recording heads by contact of a landing target such as recording paper, a case where variations in dimension of parts occur, and a case where thermal expansion occurs when the temperature rises. When such an inclination occurs, even when the recording heads are arranged at prescribed positions with respect to the sub carriage on a flat plane, the flying directions of ink ejected from the nozzles are deviated from desired original directions, so that the positional accuracy of ink landing on the landing target such as the recording paper is disadvantageously lowered.

Such a problem exists not only in the ink jet recording apparatus having the recording heads for ejecting ink mounted thereon, but also in other liquid ejecting head units employing a configuration in which the liquid ejecting head is fixed to the head fixing member such as the sub carriage via the intermediate member such as the spacer, and the liquid ejecting apparatus having the same.

SUMMARY

An advantage of some aspect of the invention is to provide a liquid ejecting head unit which allows mounting of a liquid ejecting head with respect to a head fixing member with an intermediary of an intermediate member with high degree of positional accuracy and a liquid ejecting apparatus having the same.

According to a first aspect of the invention, there is provided a liquid ejecting head unit including: a liquid ejecting head having a nozzle forming surface formed with a nozzle row made up of a plurality of nozzles arranged in a row for ejecting liquid; and a head fixing member on which the liquid ejecting head is fixed with the intermediary of an intermediate member, wherein the liquid ejecting head includes intermediate member fixing portions to which the intermediate members are tightened by tightening members respectively on both sides with the intermediary of a head body, at least one of the intermediate member fixing portion and the intermediate member fixed thereto is formed with a plurality of abutting protrusions projecting to the other side, at least two of the plurality of abutting protrusions are provided on the outside of the tightening point tightened by the tightening member in the width direction orthogonal to an imaginary line connecting the tightening points on both sides, and a gap is formed between the intermediate member fixing portion and the intermediate member at the tightening point before being tightened by the tightening member, while the intermediate member fixing portion and the intermediate member come into abutment with each other at the tightening point after having tightened by the tightening member in a state in which the respective abutting protrusions abut against the other.

According to the first aspect of the invention, the liquid ejecting head includes the intermediate member fixing portions to which the intermediate members are tightened by the tightening members respectively on both sides with the intermediary of the head member, at least any one of the fixing surface and the intermediate member to be fixed thereto is formed with the plurality of abutting protrusions projecting toward the other side, at least two of the plurality of abutting protrusions are provided on the outside of the tightening point tightened by the tightening member in the width direction orthogonal to the imaginary line connecting the tightening points on both sides with respect to each other, the gap is formed between the intermediate member fixing portion and the intermediate member at the tightening point before being tightened by the tightening member in the state in which the receptive abutting protrusions abut against the other, while the intermediate member fixing portion and the intermediate member come into abutment with each other at the tightening point after having tightened by the tightening member. In other words, in the state of being tightened by the tightening member, the respective abutting protrusions come into abutment with the other preferentially over other portions in comparison with the tightening point on the outside of the tightening point in the width direction, so that occurrence of inclination between the intermediate member fixing portion and the intermediate member, particularly in the direction orthogonal to the imaginary line connecting the tightening points on both sides is restrained. Therefore, even in the state in which the liquid ejecting head is mounted on the head fixing member with the intermediary of the intermediate member, the liquid ejecting head is restrained from being inclined in posture with respect to the head fixing member. Consequently, lowering of positional accuracy of landing with respect to the landing target of liquid ejected from the nozzles of the liquid ejecting head is prevented.

In the configuration described above, preferably, the intermediate member fixing portion and the intermediate member are tightened by the tightening member, and the intermediate member and the head fixing member are tightened by a head tightening member in a state in which adhesive agent filled without formation of a gap between a surface of the intermediate member opposite from a surface opposing the intermediate member fixing portion and a head fixing surface of the head fixing member is cured.

The expression "filled without formation of a gap" means that the adhesive agent is filled to an extent which does not cause formation of a gap which may work as a deformation margin when the tightening force generated at the time of tightening by the head tightening member is applied thereto, and the adhesive agent does not necessarily have to be completely (whole surface) filled.

According to the configuration as described above, the intermediate member fixing portion and the intermediate member are tightened by the tightening member, and the intermediate member and the head fixing member are tightened by the head tightening member in the state in which the adhesive agent filled without formation of a gap between the surface of the intermediate member opposite from the surface opposing the intermediate member fixing portion and the head fixing surface of the head fixing member is cured. Therefore, even when a gap is formed on the bonding surface between the intermediate member and the head fixing member caused by deformation of the intermediate member fixing portion or the intermediate member due to the tightening force of the tightening member, since the adhesive agent is filled in the gap and cured, there is no gap which works as a deformation margin. Therefore, even when the tightening force generated at the time of tightening by the head tightening member acts, deformation of the intermediate member or the head fixing member is restrained. Accordingly, the position of the liquid ejecting head with respect to the head fixing member is prevented from being displaced. Consequently, both the prevention of inclination of the liquid ejecting head with respect to the head fixing member and the securement of the positional accuracy can be established simultaneously.

Preferably, a first tightening member insertion port which allows insertion of the tightening member is formed at a center portion of the respective intermediate member fixing portions in the width direction, while a second tightening member insertion port is formed on the intermediate member at a position corresponding to the first tightening member insertion port, and a gap is formed between an opening limb portion of the first tightening member and an opening limb portion of the second tightening member insertion port before being tightened by the tightening member, and the opening limb portion of the first tightening member insertion port and the opening limb portion of the second tightening member insertion port are in abutment with each other after having tightened by the tightening member in a state in which the respective abutting protrusions are in abutment with the other.

Preferably, the tightening point between the intermediate member and the head fixing member is provided on the outside of the tightening point between the intermediate member fixing portion and the intermediate member in the width direction and the abutting protrusions are provided on the outside of the tightening point between the intermediate member and the head fixing member in the width direction.

In this configuration, the tightening point between the intermediate member and the head fixing member is provided on the outside of the tightening point between the intermediate member fixing member and the intermediate member in the width direction, and the abutting protrusions are provided on the outside of the tightening point between the intermediate member and the head fixing member in the width direction, so that the respective abutting protrusions come into abutment on the outside of the respective tightening points in the width direction, occurrence of inclination between the intermediate member fixing portion and the intermediate member is restrained further reliably.

According to a second aspect of the invention, there is provided a liquid ejecting apparatus including a liquid ejecting head unit having: a liquid ejecting head having a nozzle forming surface formed with a nozzle row made up of a plurality of nozzles arranged in a row for ejecting liquid, and a head fixing member to be fixed with the intermediary of a intermediate member, wherein the liquid ejecting head includes intermediate member fixing portions to which the intermediate members are tightened by tightening members respectively on both sides with the intermediary of a head body, at least one of the intermediate member fixing portion and the intermediate member fixed thereto is formed with a plurality of abutting protrusions projecting to the other side, at least two of the plurality of abutting protrusions are provided on the outside of the tightening point tightened by the tightening member in the width direction orthogonal to an imaginary line connecting the tightening points on both sides, and a gap is formed between the intermediate member fixing portion and the intermediate member at the tightening point before being tightened by the tightening member, while the intermediate member fixing portion and the intermediate member come into abutment with each other at the tightening point after having tightened by the tightening member in a state in which the respective abutting protrusions abut against the other.

BRIEF DESCRIPTION OF THE DRAWINGS

The invention will be described with reference to the accompanying drawings, wherein like numbers reference like elements.

DESCRIPTION OF EXEMPLARY EMBODIMENTS

Referring now to attached drawings, embodiments of the invention will be described below. In the embodiments described below, various definitions are made as preferred embodiments of the invention. However, the scope of the invention is not limited to these modes unless otherwise specified in description given below to the effect of defining the invention. Also, in the following description, an ink jet recording apparatus (hereinafter, referred to as a printer) will be described as an example of a liquid ejecting apparatus in the invention.

Figure 1:
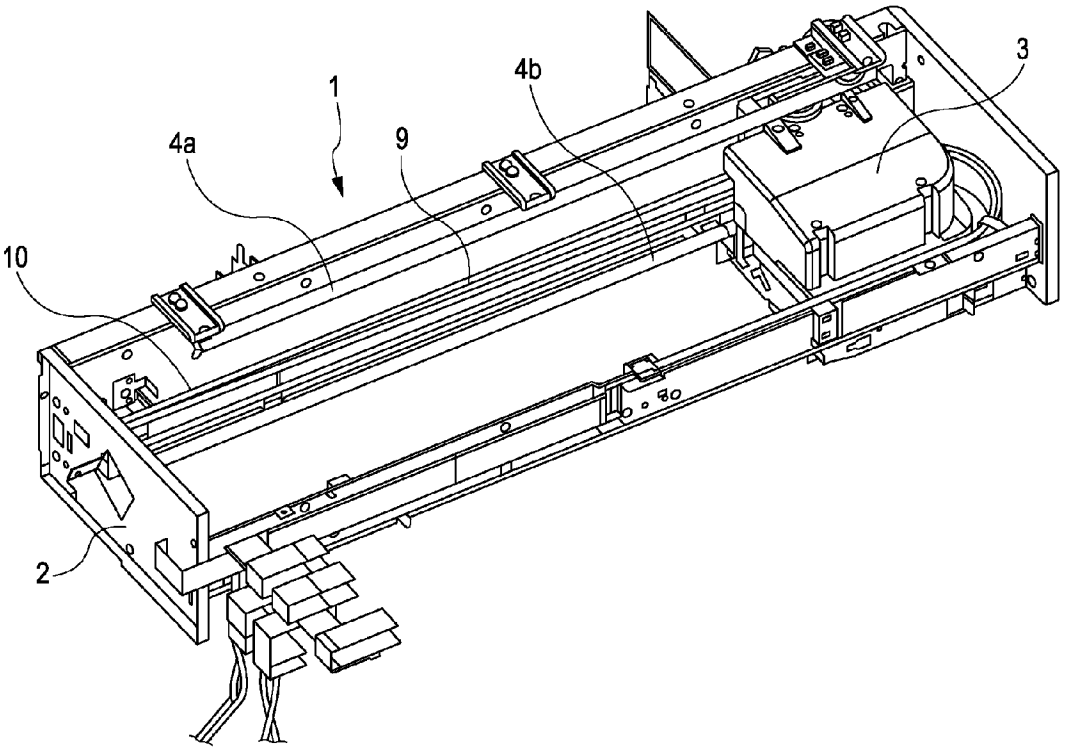
FIG. 1 is a perspective view showing part of an internal configuration of a printer.
Figure 2:
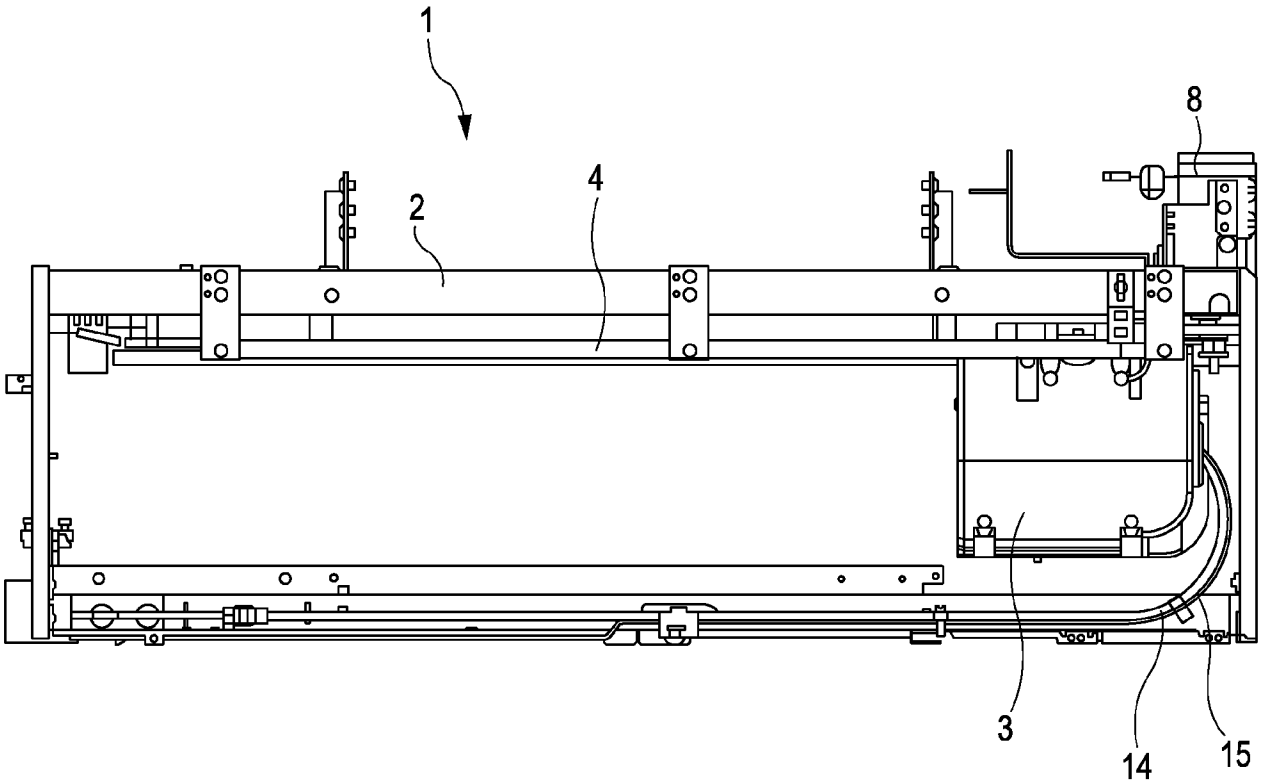
FIG. 2 is a plan view of the printer.

FIG. 1 is a perspective view showing part of an internal configuration of a printer 1, and FIG. 2 is a plan view of the printer 1. The exemplified printer 1 ejects ink as a kind of liquid toward a recording medium (landing target) such as recording paper, cloths, and films. The printer 1 includes in the interior of the frame 2 a carriage 3 (a kind of head unit holding member) mounted thereon so as to be capable of reciprocating in a primary scanning direction, which is a direction intersecting the direction of transport of the recording medium. Mounted on an inner wall of the frame 2 on the back side of the printer 1 are a pair of upper and lower elongated guide rods 4*a* and 4*b* extending along the longitudinal direction of the frame 2 in parallel at a distance from each other. The carriage 3 is supported so as to be slidable with respect to the guide rods 4*a* and 4*b* by the guide rods 4*a* and 4*b* being fitted to a bearing portion 7 (see FIG. 4) provided on the back side thereof.

Disposed on the back side of the frame 2 and on one end side in the primary scanning direction (a right end portion in FIG. 2) is a carriage motor 8 as a drive source for moving the carriage 3. A drive shaft of the carriage motor 8 projects toward the inner surface from the back side of the frame 2, and a drive pulley (not shown) is connected to a distal end portion thereof. The drive pulley is rotated by driving of the carriage motor 8. In addition, provided at a position opposite from the drive pulley in the primary scanning direction (a left end portion in FIG. 2) is an idling pulley (not shown). A timing belt 9 is entrained about these pulleys. The carriage 3 is connected to the timing belt 9. When the carriage motor 8 is driven, the timing belt 9 rotates in association with the rotation of the drive pulley, and the carriage 3 moves in the primary scanning direction along the guide rods 4*a* and 4*b*.

A linear scale 10 (encoder film) is extended on an inner wall of a back surface of the frame 2 in parallel with the guide rods 4*a* and 4*b* along the primary scanning direction. The linear scale 10 is a band-shaped member formed of a transparent resin film and, for example, a plurality of opaque strips traversing the direction of the band width are printed on the surface of a transparent base film. The respective stripes have the same width and are formed at constant pitches in the longitudinal direction of the band. Provided on the back side of the carriage 3 is a linear encoder (not shown) configured to optically read the stripes on the linear scale 10. The linear encoder is a kind of a positional information output device, and outputs encoder pulses according to the scanning position of the carriage 3 as positional information in the primary scanning direction. Accordingly, a control unit (not shown) of the printer is capable of controlling recording actions with respect to the recording medium by the head unit 17 while recognizing the scanning position of the carriage 3 on the basis of the encoder pulse. Then, the printer 1 is configured to be capable of so called a both direction recording process which records characters, images, and the like on the recording paper in both directions, namely, an outbound direction in which the carriage 3 moves from a home position on one end side toward an opposite end (full position) in the primary scanning direction, and an inbound direction in which the carriage 3 moves back from the full position to the home position.

Figure 3:
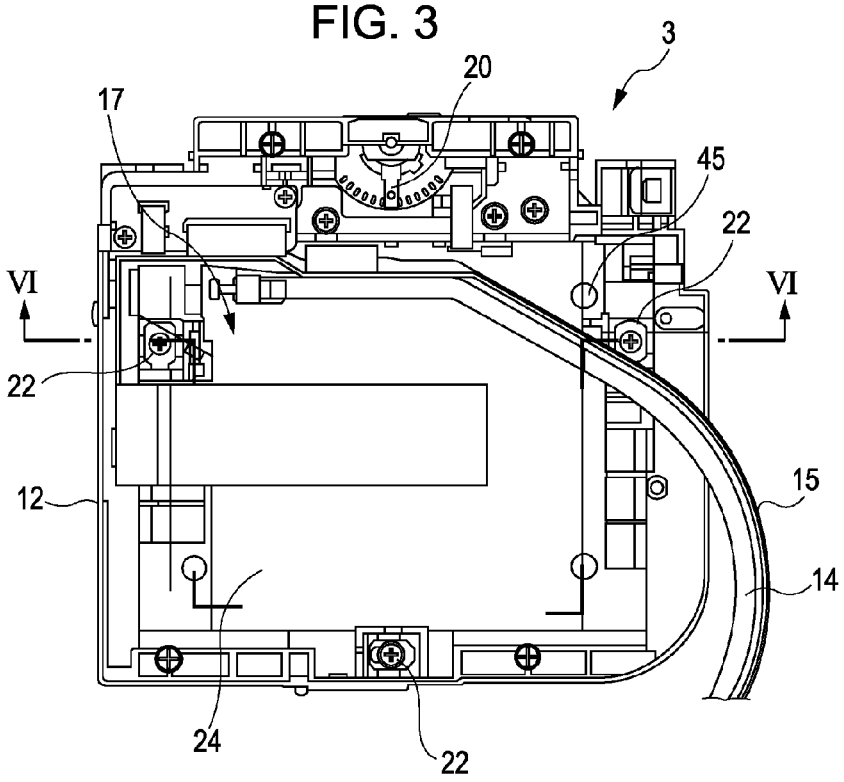
FIG. 3 is a top view of a carriage.

As shown in FIG. 3, an ink supply tube 14 configured to supply ink in respective colors to the respective recording heads 18 of a head unit 17 and a signal cable 15 configured to supply signals such as drive signals are connected to the carriage 3. In addition, although not shown in the drawings, the printer 1 further includes a cartridge mounting portion on which ink cartridges (liquid supply sources) in which ink is stored are demountably mounted, a transporting portion configured to transport recording paper, and a capping unit configured to cap a nozzle forming surface 53 (see FIG. 12) of the recording head 18 in the waiting state.

Figure 4:
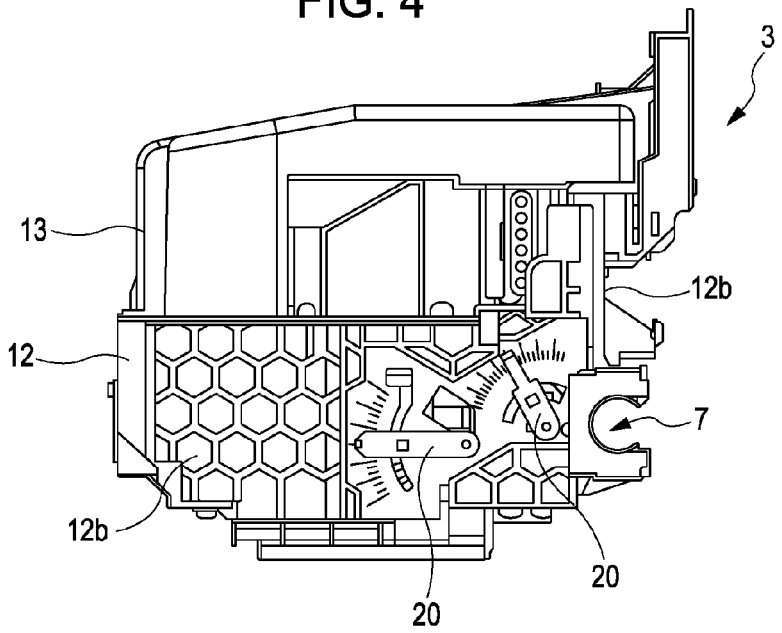
FIG. 4 is a right side view of the carriage.
Figure 5:
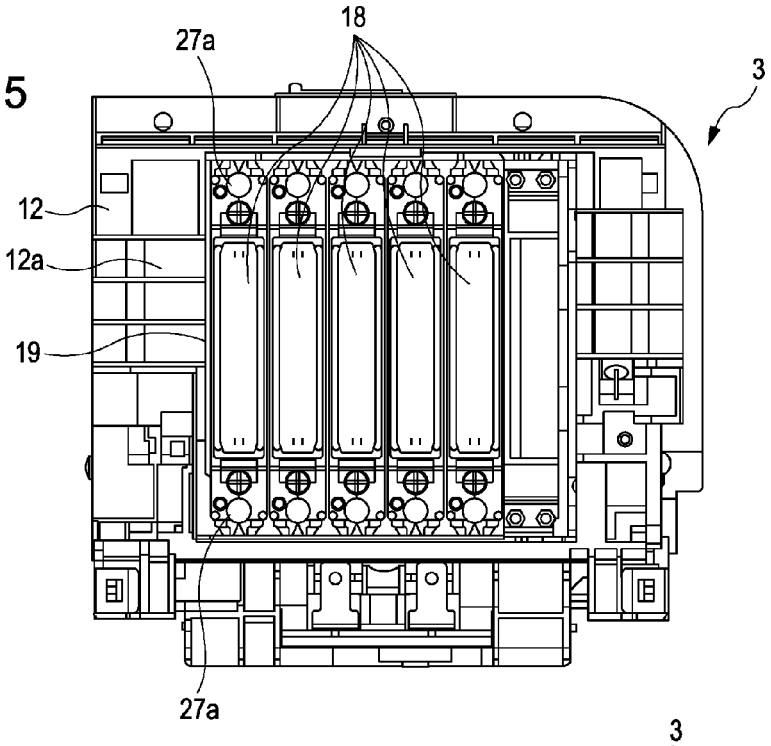
FIG. 5 is a bottom view of the carriage.
Figure 6:
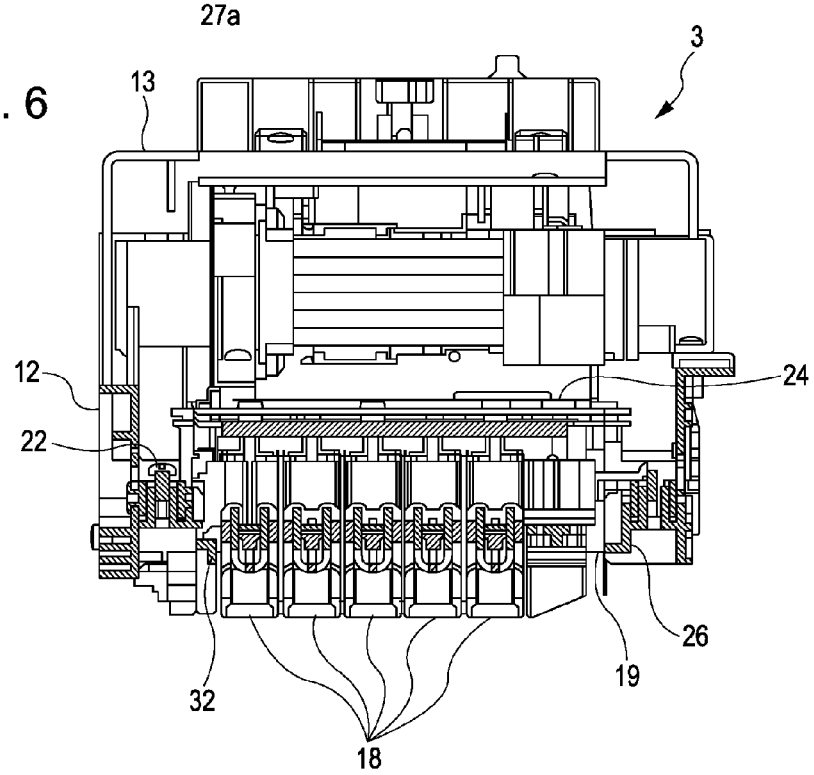
FIG. 6 is a cross-sectional view taken along the line VI-VI in FIG. 3.

FIG. 3 is a plan (top) view of the carriage 3, FIG. 4 is a right side view of the carriage 3, and FIG. 5 is a bottom view of the carriage 3. FIG. 6 is a cross-sectional view taken along the line VI-VI in FIG. 3. FIG. 3 shows a state in which a carriage cover 13 is demounted. The carriage 3 includes a carriage body 12 having the head unit (a kind of liquid ejecting head unit in the invention), described later, mounted in the interior thereof, and the carriage cover 13 configured to close up an upper opening of the carriage body 12, and is a member of a hollow box shape which can be separated in an upper portion and a lower portion. The carriage body 12 includes a substantially rectangular-shaped bottom plate portion 12*a* and side wall portions 12*b* extending respectively upward from outer peripheral edges on four sides of the bottom plate portion 12*a*, and the head unit 17 is received in a space surrounded by the bottom plate portion 12*a* and the side wall portions 12*b*. The bottom plate portion 12*a* is formed with a bottom opening 19 for exposing the nozzle forming surfaces 53 of the respective recording heads 18 of the received head unit 17. Then, in a state in which the head unit 17 is received in the carriage body 12, the nozzle forming surfaces 53 of the respective recording heads 18 project from the bottom opening 19 of the bottom plate portion 12*a* downward (the side of the recording medium at the time of recording action) of a bottom portion of the carriage body 12.

Figure 7A:
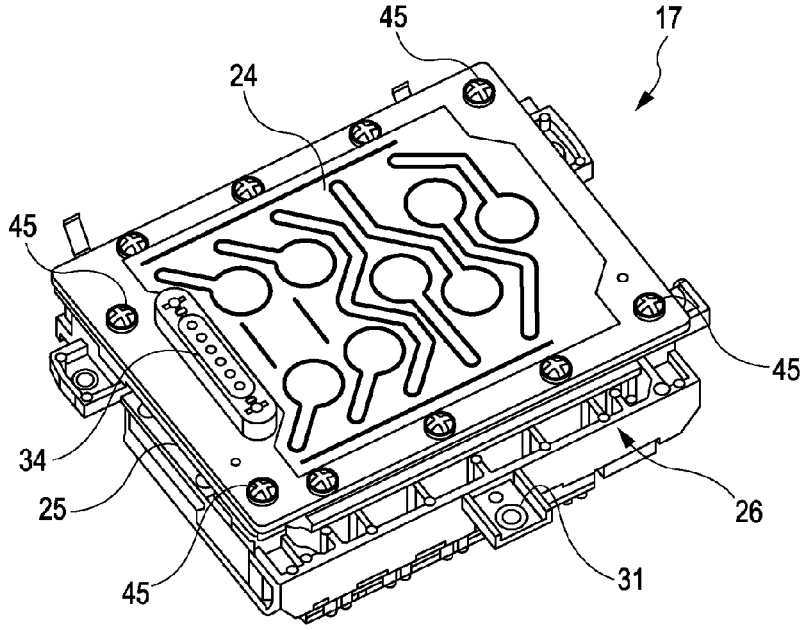
FIGS. 7A and 7B are perspective views of a head unit.
Figure 7B:
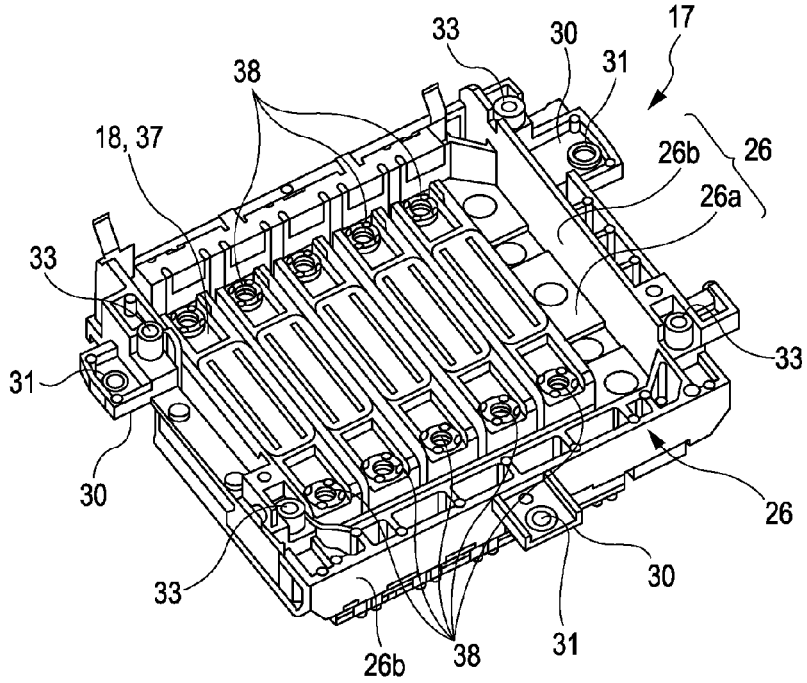
Figure 8:
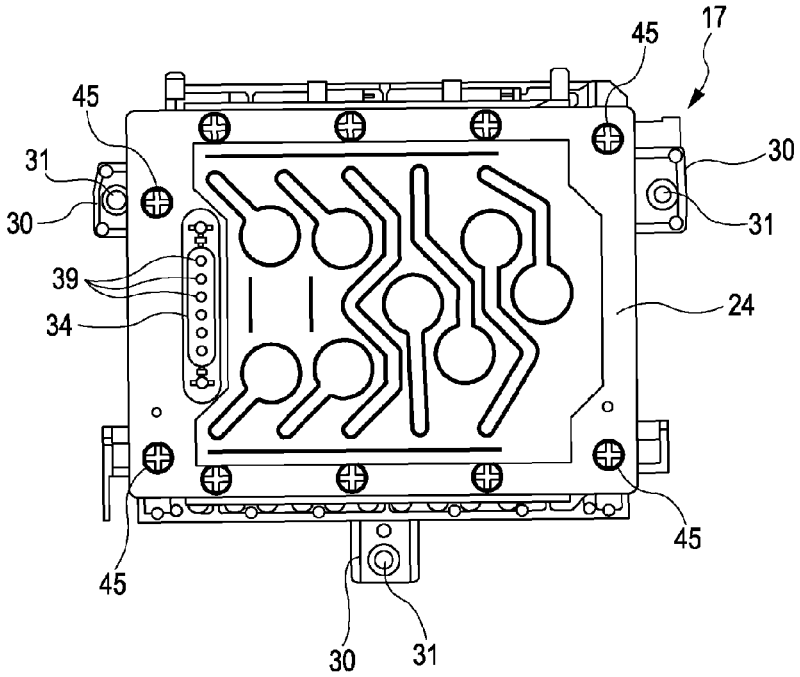
FIG. 8 is a top view of the head unit.
Figure 9:
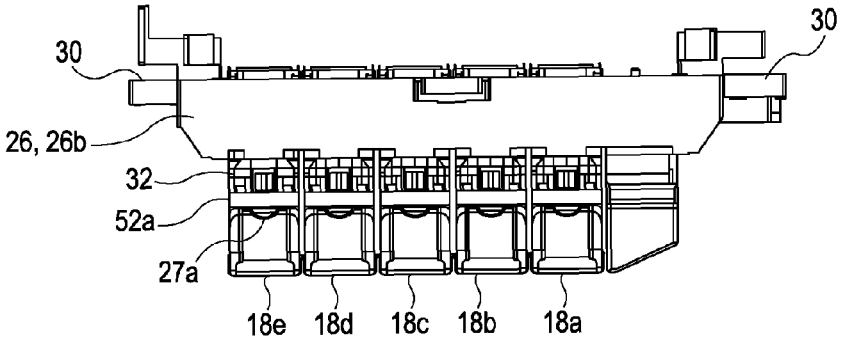
FIG. 9 is a front view of the head unit.

FIG. 7A is a perspective view of the head unit 17 showing a state in which a flow channel member 24 is mounted, and FIG. 7B is a perspective view of the head unit showing a state in which the flow channel member 24 is removed. FIG. 8 is a top view of the head unit 17, FIG. 9 is a front view of the head unit 17 (the state in which the flow channel member 24 is removed), FIG. 10 is a bottom view of the head unit 17, and FIG. 11 is a perspective view on the bottom side of the head unit 17.

The head unit 17 is a unitized body including a plurality of the recording heads 18, and includes a sub carriage 26 (a kind of head fixing member in the invention) to which the recording heads 18 are mounted, and the flow channel member 24. The sub carriage 26 includes a plate-shaped base portion 26*a* to which the recording heads 18 are fixed, and upright wall portions 26*b* extending respectively upward from outer peripheral edges on four sides of the base portion 26*a*, and is formed into a hollow box shape opening on top. A space surrounded by the base portion 26*a* and the upright wall portions 26*b* on four sides functions as a receiving portion configured to receive at least part of the recording heads 18 (mainly sub tanks 37). The sub carriage 26 in this embodiment is formed of metal, for example, aluminum, and is enhanced in rigidity in comparison with the carriage body 12 and the carriage cover 13. The material of the sub carriage 26 is not limited to the metal, and synthetic resin may also be employed.

Formed at a substantially center portion of the base portion 26*a* of the sub carriage 26 is a head insertion opening 28 which allows insertion of the plurality of recording heads 18 (that is, one common for the respective recording heads 18). Therefore, the base portion 26*a* has a frame-shaped frame member including the four sides. Formed on a lower surface of the base portion 26*a* (a surface on the side opposing the recording medium at the time of recording) are securing holes 29 corresponding to mounting positions of the respective recording heads 18 (see FIG. 23). In this embodiment, four of the securing holes 29 in total, that is, two each of the securing holes 29, are provided for the mounting position of each recording head 18 on side portions on both sides of the head insertion opening 28 in the direction corresponding to the nozzle rows direction (the direction orthogonal to the direction of arrangement of the heads) in one-to-one correspondence to sub carriage insertion holes 69 of a spacer 32 described later.

Figure 10:
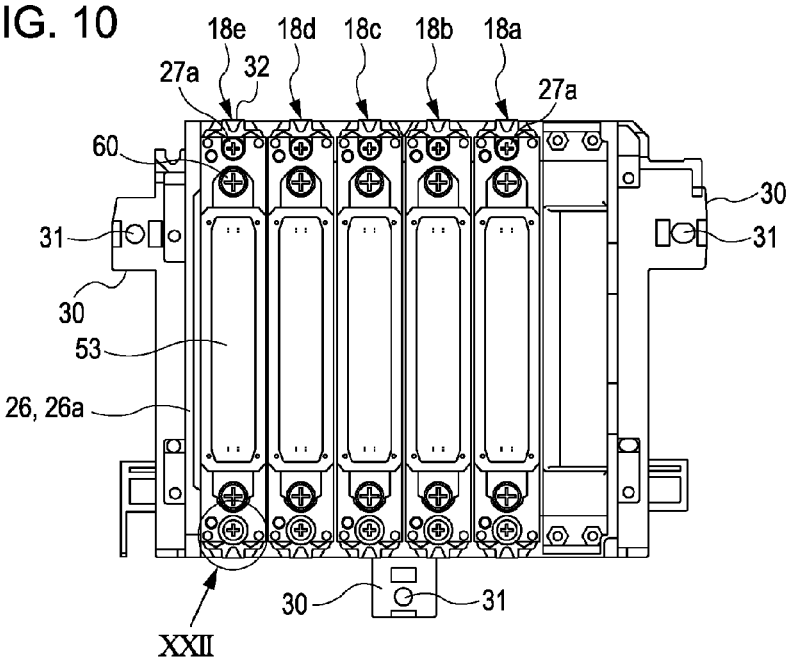
FIG. 10 is a bottom view of the head unit.
Figure 11:
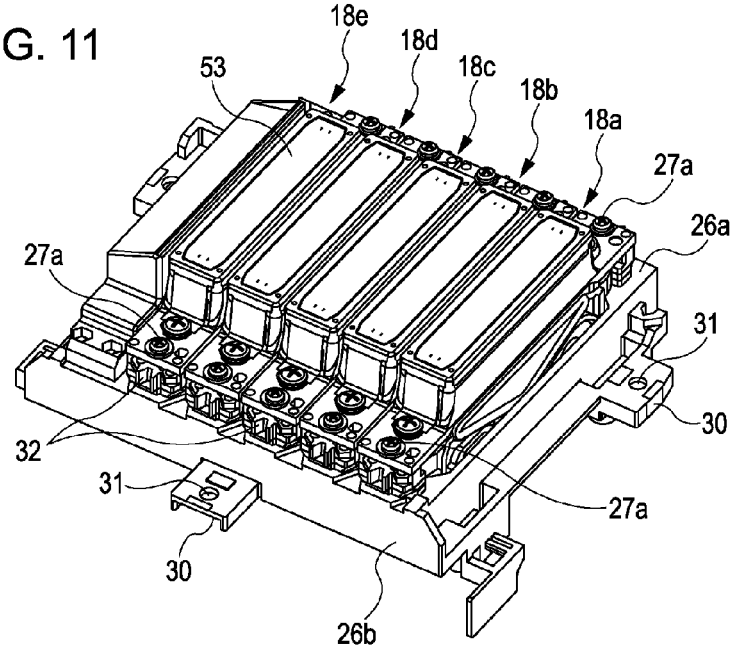
FIG. 11 is a perspective view of the head unit on the bottom side.

In this embodiment, as shown in FIG. 10, five of the recording heads 18 in total including a first recording head 18*a*, a second recording head 18*b*, a third recording head 18*c*, a fourth recording head 18*d*, and a fifth recording head 18*e* are fixed to the base portion 26*a* side-by-side in the direction orthogonal to the nozzle row respectively with the sub tanks 37, described later, received in the receiving portion by being inserted from below the head insertion opening 28, and the spacers 32 interposed with respect to the base portion 26*a*.

As shown in FIGS. 7A and 7B and FIG. 8, three of the upright wall portions 26*b* on the four side of the sub carriage 26 are each provided with a flange portion 30 so as to project sideward. The flange portions 30 are each formed with an insertion hole 31 corresponding to each of mounting screw holes, not shown, formed at three positions on the bottom plate portion 12*a* of the carriage body 12 at a mounting position for mounting the head unit 17. Then, the head unit 17 is received in and fixed to the interior of the carriage body 12 by securing head unit fixing screws 22 to the mounting screw holes through the insertion holes 31 in a state in which the positions of the insertion holes 31 are aligned with the corresponding mounting screw holes of the bottom plate portion 12*a* of the carriage body 12. Also, four fixing screw holes 33 in total for fixing the flow channel member 24 are provided on upper end surfaces of the upright wall portions 26*b* on four sides of the sub carriage 26.

The flow channel member 24 is a box-shaped member being thin in the vertical direction and is formed of synthetic resin, for example. In the interior of the flow channel member 24, ink distributing channels (not shown) for respective colors corresponding respectively to flow channel connecting portions 38 of the sub tanks 37 (described later) of the respective recording heads 18 are partitioned. Provided on an upper surface (a surface opposite from a surface which is fixed to the sub carriage 26) of the flow channel member 24 is a tube connecting portion 34. As shown in FIG. 8, a plurality of introduction ports 39 corresponding to the inks in the respective colors are provided in the interior of the tube connecting portion 34. The respective introduction ports 39 communicate with ink distributing channels of corresponding colors respectively. Then, when the ink supply tubes 14 described above are connected to the tube connecting portion 34, the ink supply channels of respective colors in the ink supply tubes 14 and the introduction ports 39 corresponding thereto respectively communicate in a liquid-tight manner. Accordingly, the ink in the respective colors fed through the ink supply tubes 14 from the ink cartridges are introduced into the ink distributing channels in the interior of the flow channel member 24 through the introduction ports 39, respectively. On a lower surface of the flow channel member 24 at positions corresponding to the flow channel connecting portions 38 of the sub tanks 37 of the respective recording heads 18, connecting channels, not shown, are provided. The respective connecting channels are configured to be inserted respectively into the flow channel connecting portions 38 of the sub tanks 37 of the respective recording heads 18 and coupled thereto in a liquid-tight manner. In addition, channel insertion holes (not shown) corresponding to the fixing screw holes 33 of the sub carriage 26 are formed in a state of penetrating through the thickness direction at four corners of the flow channel member 24 respectively. When the flow channel member 24 is fixed to the sub carriage 26, flow channel securing screws 45 are secured (screwed) to the fixing screw holes 33 via the flow channel insertion holes. Then, the inks passing through the ink distributing channels in the interior of the flow channel member 24 are supplied to the sub tanks 37 of the respective recording heads 18 via the connecting channels and the flow channel connecting portions 38.

Figure 12:
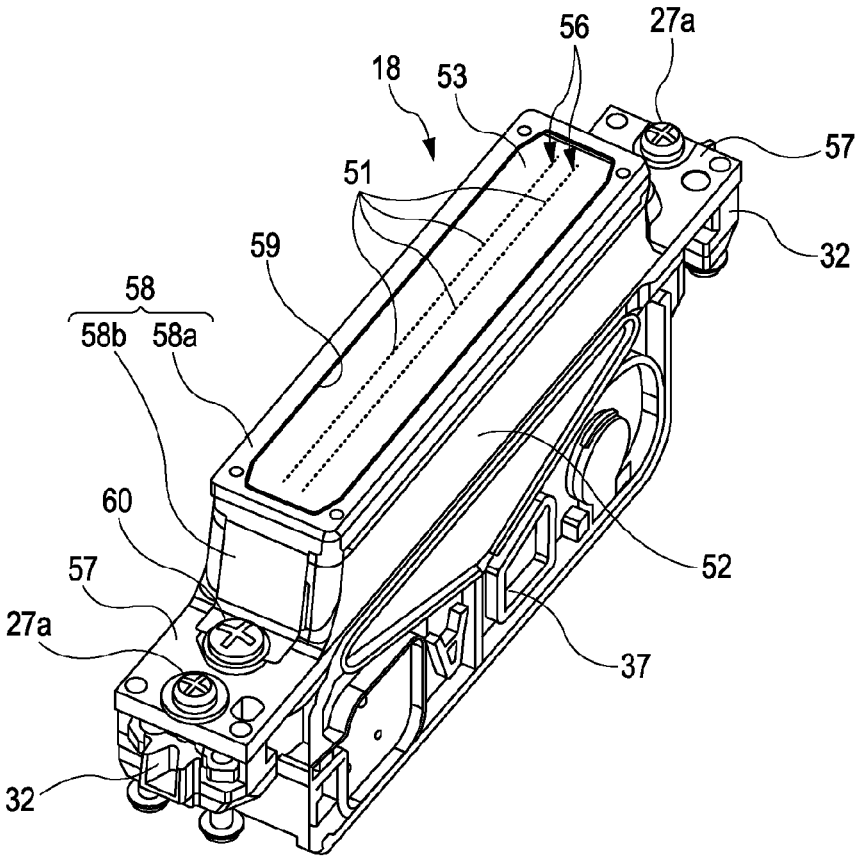
FIG. 12 is a perspective view for explaining a configuration of a recording head.
Figure 13A:
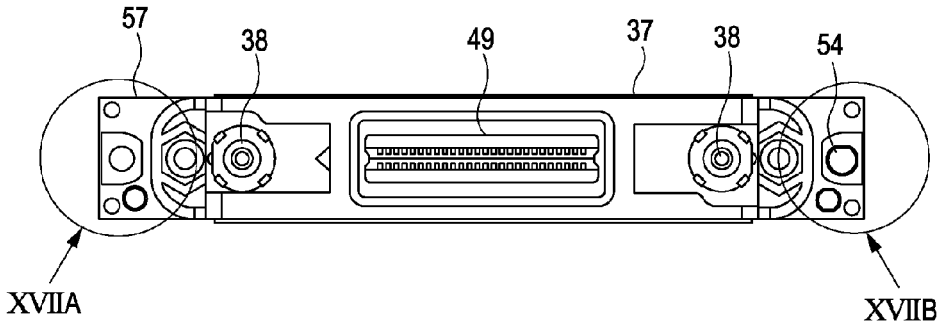
FIGS. 13A and 13B are top views for explaining the configuration of the recording head.
Figure 13B:
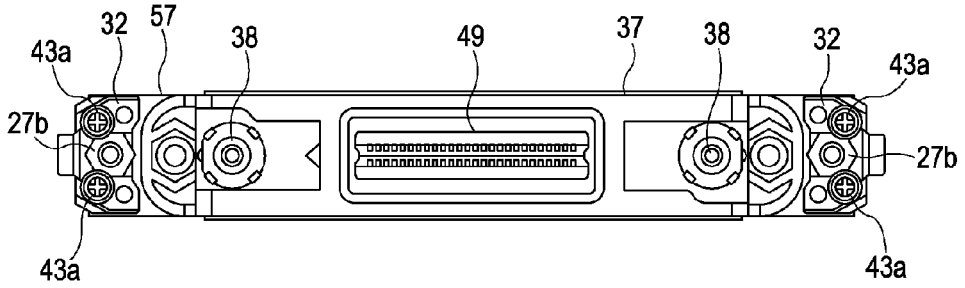
Figure 14A:
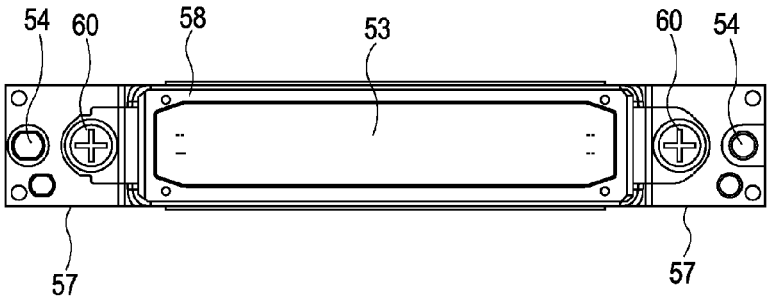
FIGS. 14A and 14B are bottom views for explaining the configuration of the recording head.
Figure 14B:
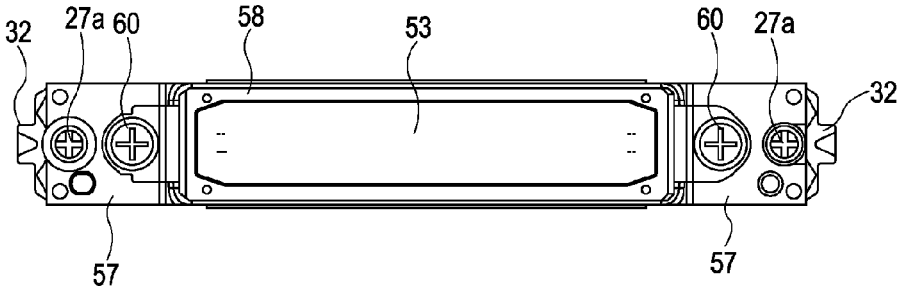
Figure 15A:
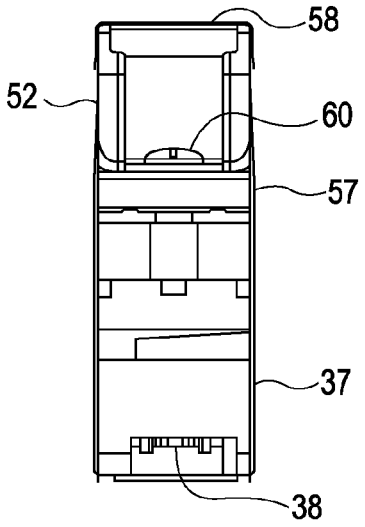
FIGS. 15A and 15B are front views for explaining the configuration of the recording head.
Figure 15B:
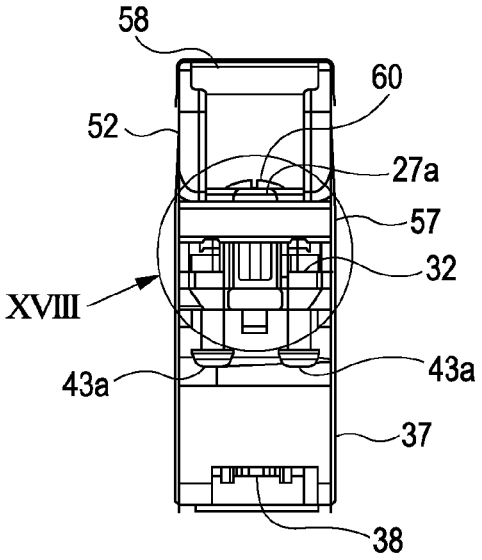
Figure 16A:
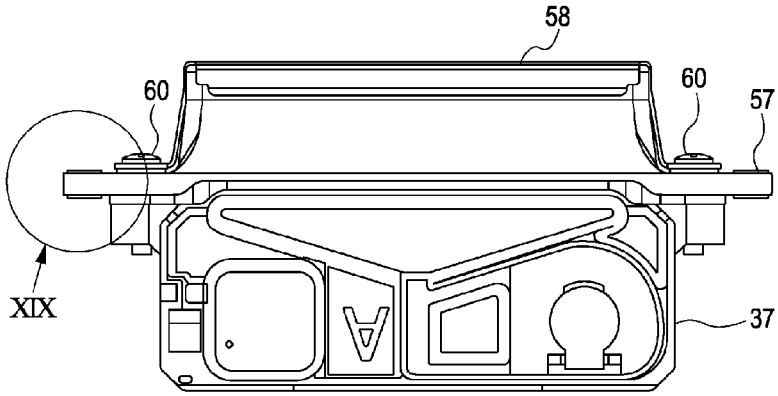
FIGS. 16A and 16B are right side views for explaining the configuration of the recording head.
Figure 16B:
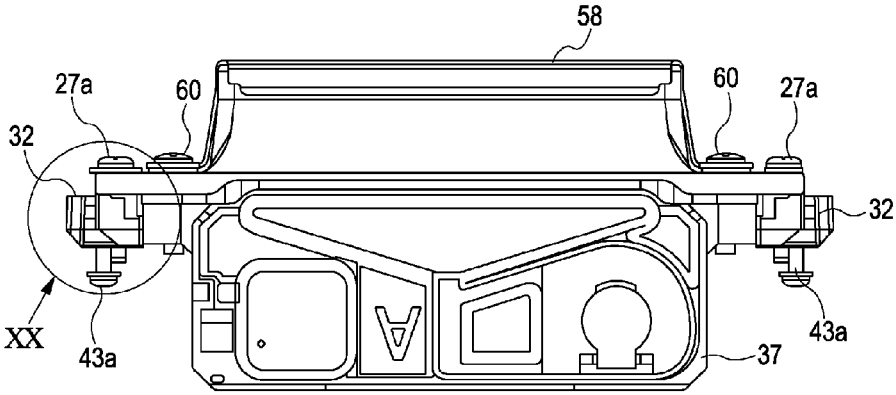

FIG. 12 is a perspective view for explaining a configuration of the recording head 18 (a kind of the liquid ejecting head). FIG. 13A is a top view of the recording head 18, showing a state in which the spacer 32 is not mounted, and FIG. 13B is a top view of the recording head 18, showing a state in which the spacer 32 is mounted. FIG. 14A is a bottom view of the recording head 18, showing the state in which the spacer 32 is not mounted, and FIG. 14B is a bottom view of the recording head 18, showing the state in which the spacer 32 is mounted. FIG. 15A is a front view of the recording head 18, showing the state in which the spacer 32 is not mounted, and FIG. 15B is a front view of the recording head 18, showing the state in which the spacer 32 is mounted. FIG. 16A is a right side view of the recording head 18, showing the state in which the spacer 32 is not mounted, and FIG. 16B is a right side view of the recording head 18, showing the state in which the spacer 32 is mounted.

Figure 17A:
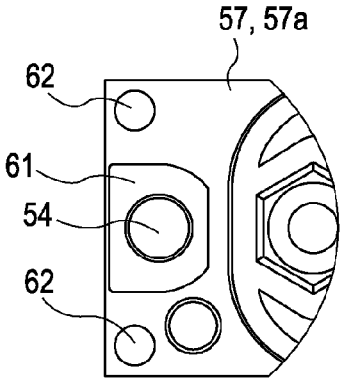
FIGS. 17A and 17B are enlarged views of an area XVIIA in FIG. 13A and an area XVIIB in FIG. 13A.
Figure 17B:
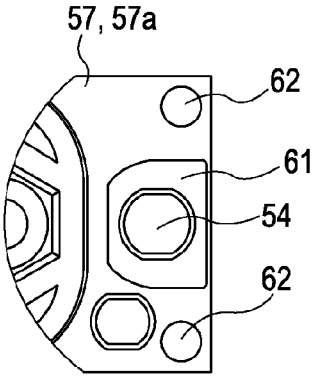
Figure 18:
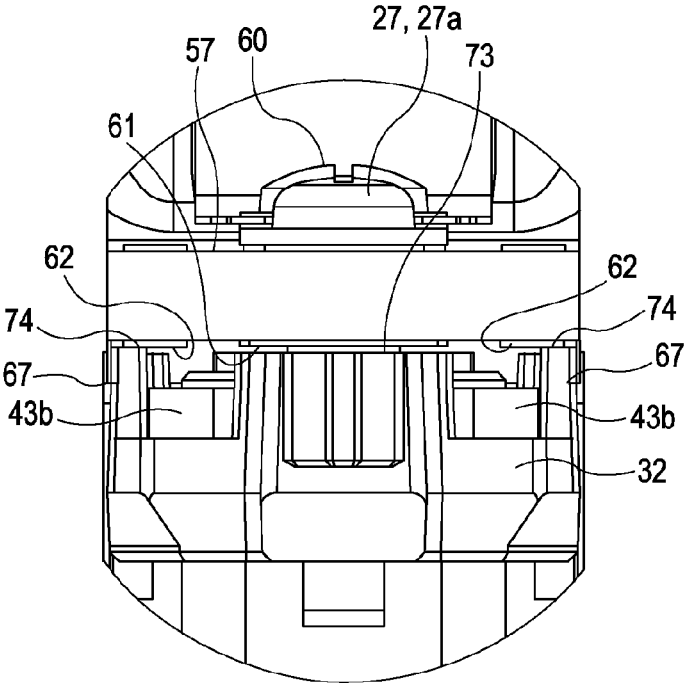
FIG. 18 is an enlarged view of an area XVIII in FIG. 15B.
Figure 19:
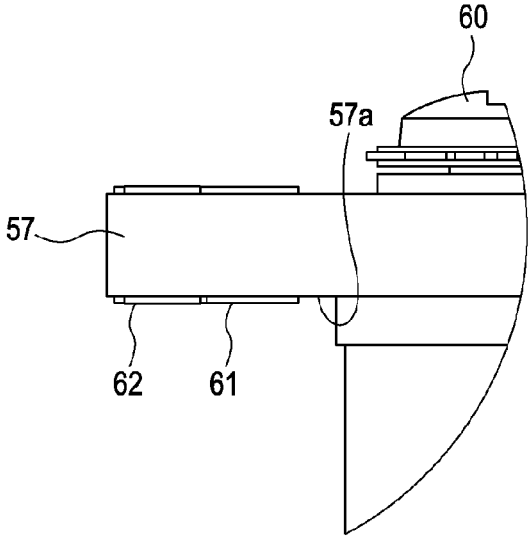
FIG. 19 is an enlarged view of an area XIX in FIG. 16A.
Figure 20:
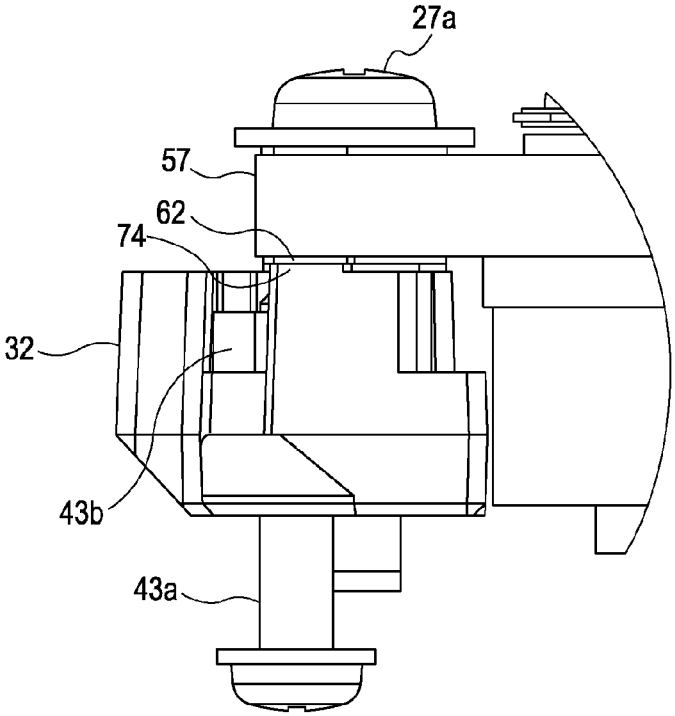
FIG. 20 is an enlarged view of an area XX in FIG. 16B.

FIG. 17A is an enlarged view of an area XVIIA in FIG. 13, and FIG. 17B is an enlarged view of an area XVIIB in FIG. 13. FIG. 18 is an enlarged view of an area XVIII in FIG. 15B, and FIG. 19 is an enlarged view of an area XIX in FIG. 16. FIG. 20 is an enlarged view of an area XX in FIG. 16. The basic structure are common for the respective recording heads 18, and hence only one of the five recording heads 18 to be mounted on the sub carriage 26 is illustrated as a representative.

The recording head 18 includes a flow channel unit (not shown) which forms ink flow channels including pressure chambers communicating with nozzles 51 and a pressure generating devices (not shown) such as piezoelectric vibrators or heat generating elements which cause pressure variations in ink in the pressure chambers in a head case 52. The recording head 18 in this embodiment is formed into a shape elongated in the nozzle row direction in plan view, and short in the width direction orthogonal to the nozzle rows. The recording head 18 is configured to perform a recoding action ejecting ink from the nozzles 51 and causing the ejected ink to land onto the recording medium such as the recording paper by applying a drive signal from the control unit of the printer 1 to the pressure generating device and drive the pressure generating device. The nozzle forming surface 53 of each of the recording heads 18 is formed with a nozzle row 56 (nozzle group) including a plurality of rows of the nozzles 51 which eject ink, and two of the nozzle rows 56 are formed side by side in the direction orthogonal to the nozzle row. The nozzle rows 56 each includes 360 nozzles formed at a pitch of 360 dpi, for example.

The head case 52 is a hollow box-shaped member and is a kind of head body in the invention. The flow channel unit is fixed to the distal end side of the head case 52 in a state in which the nozzle forming surface 53 is exposed. The pressure generating device is received in the receiving space formed in the interior of the head case 52, and the sub tank 37 for supplying ink to the flow channel unit is mounted on the proximal side (upper surface side) opposite from a distal end surface. The head case 52 is formed with flange portions 57 (which correspond to an intermediate member fixing portion in the invention) on the side of the upper surface thereof on both sides in the nozzle row direction so as to project sideward, respectively. The flange portion is formed with a spacer mounting hole 54 (which corresponds to first tightening member insertion port in the invention) corresponding to a head insertion hole 68 of the spacer 32, as shown in FIGS. 17A and 17B. When mounting the spacer 32 to the flange portions 57 on both sides respectively, shaft portions of spacer fixing bolts 27*a* are inserted into the spacer mounting holes 54.

The spacer mounting holes 54 are formed at the center portions of the flange portions 57 in the flange width direction, which is a direction orthogonal to the direction of arrangement of the flange portions 57 on both sides (the direction orthogonal to the direction of arrangement of the tightening points with respect to the spacer 32 or the direction orthogonal to the nozzle row) in a state of penetrating therethrough in the direction of the thickness of the flange portion 57. One of the spacer mounting holes 54 formed on the flange portions 57 on both sides (left side in FIG. 13A) is a through hole having a circular hole shape in plan view as shown in FIG. 17A, and the inner diameter thereof is set to be slightly larger than the outer diameter of the shaft portion of the spacer fixing bolt 27*a*. Accordingly, the one of the spacer mounting holes 54 allows smooth insertion of the shaft portion of the spacer fixing bolt 27*a* and, in addition, is configured so as not to cause rattling easily between the both members. In contrast, the other spacer mounting hole 54 (right side in FIG. 13A) is an elongated hole elongated in the direction of arrangement of the spacer mounting holes 54 (the nozzle row direction) in plan view as shown in FIG. 17B. The inner diameter (long diameter) of the other spacer mounting hole 54 in the direction of arrangement of the mounting holes is set to be sufficiently larger than the outer diameter of the shaft portion of the spacer fixing bolt 27*a*, and the inner diameter (short diameter) in the flange width direction orthogonal to the direction of arrangement of the mounting holes is set to match the inner diameter of the one of the spacer mounting holes 54. In this manner, by employing a circular hole for one of the spacer mounting holes 54 formed on the flange portions 57 on both sides and an elongated hole for the other one of those, when the respective spacers 32 fixed respectively to the both flange portions 57 are screwed to a head mounting portion of the sub carriage 26, the error between the distance between the securing holes 29 on the side of the sub carriage 26 and the distance between the spacer mounting holes 54 is allowed within the range of the long diameter of the elongated hole.

An opening limb portion 61 of the spacer mounting hole 54 projects toward the spacer 32 in the mounted state with respect to a spacer fixing surface 57*a* (an intermediate member fixing surface) of the flange portion 57. The opening limb portion 61 is a bank-like projection formed in a state of surrounding the periphery of the opening of the spacer mounting hole 54. Formed in the spacer fixing surfaces 57*a* of the flange portions 57 on both outsides in the flange width direction with respect to the spacer mounting holes 54 respectively are abutting protrusions 62 in a circular shape in plan view. In this embodiment, the abutting protrusions 62 are provided at outer corners of the flange portions 57 on both sides, respectively. The abutting protrusions 62 of the spacer mounting hole 54 project toward the spacer 32 in the mounted state with respect to the spacer fixing surface 57*a* of the flange portion 57. The amount of projection of the abutting protrusions 62 from the spacer fixing surface 57*a* is set to be slightly larger than the amount of projection of the opening limb portion 61 of the spacer mounting hole 54 from the spacer fixing surface 57*a*. With the configuration of the opening limb portion 61 of the spacer mounting hole 54 and the abutting protrusions 62 in this manner, distal end surfaces of the abutting protrusions 62 come into abutment with abutting projections 74 (described later) of the spacer 32 and, on the other hand, the distal end surface of the opening limb portion 61 is slightly away from an insertion hole limb portion 73 (described later) of the spacer 32 and hence a gap G (see FIG. 23) is generated in this portion in a state in which the spacer 32 is arranged on the flange portion 57 (in a state in which a tightening force at the time of tightening the spacer fixing bolt 27*a* and a spacer fixing nut 27*b* does not act on the spacer 32 and the flange portion 57).

A cover member 58 configured to protect the peripheral edge portions of the flow channel unit and the nozzle forming surface 53 from contact of the recording paper or the like is mounted on the head case 52 on the distal end surface thereof. The cover member 58 is formed of a thin metal plate having electric conductivity such as stainless steel. The cover member 58 in this embodiment roughly includes a frame-shaped frame portion 58*a* having an opening window portion 59 formed at a center portion thereof, and side panel portions 58*b* extending from edge portions of the frame portion 58*a* on both sides in the nozzle row direction respectively along side surfaces of the head case 52 in a state of being mounted on the head case 52. Distal end portions of the respective side panel portions 58*b* are bent outward so as to conform the shape of the flange portions 57 and are screwed to the flange portions 57 by cover securing screws 60. The cover member 58 also have a function to adjust the nozzle forming surface 53 to a ground potential in addition to the function to protect the peripheral edge portions of the flow channel unit and the nozzle forming surface 53.

The sub tank 37 is a member configured to introduce ink from the flow channel member 24 to the pressure chambers of the recording head 18. The sub tank 37 has a self-sealing function to open and close a valve according to the pressure variations in the interior and control introduction of the ink toward the pressure chambers. The flow channel connecting portions 38 to which the connecting channels of the flow channel member 24 are connected are provided at both end portions in the nozzle row direction on a rear end surface (upper surface) of the sub tank 37. The flow channel connecting portions 38 are each fitted with a ring-shaped packing, not shown, and with this packing, the liquid-tight properties with respect to the flow channel member 24 is secured. Provided in the interior of the sub tank 37 is a driving substrate for supplying a drive signal to the pressure generating device (not shown). Disposed in the interior of the opening at the center of the rear end surface of the sub tank 37 is a connector 49 configured to electrically connect a flexible cable (a kind of a wiring member, not shown) to the driving substrate.

Figure 21A:
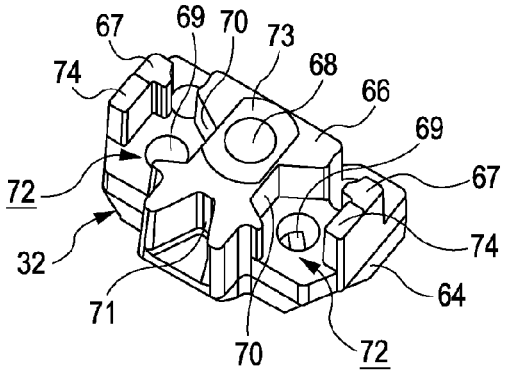
FIG. 21A to 21E are drawings for explaining a configuration of a spacer.
Figure 21B:
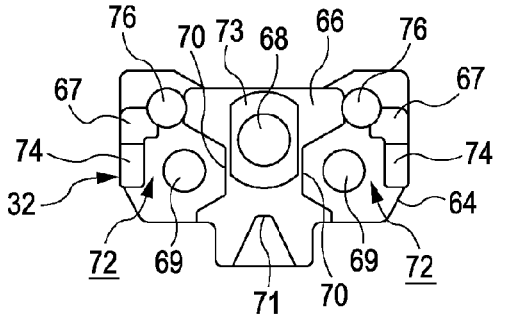
Figure 21C:
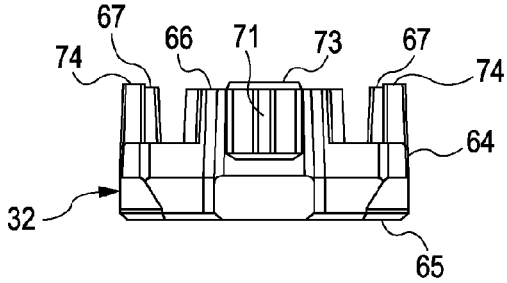
Figure 21D:
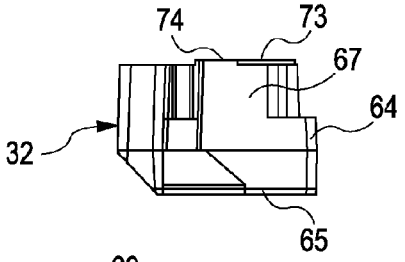
Figure 21E:
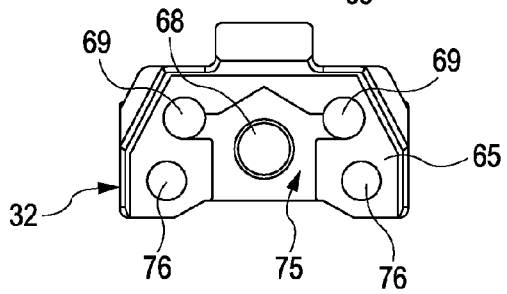
Figure 22:
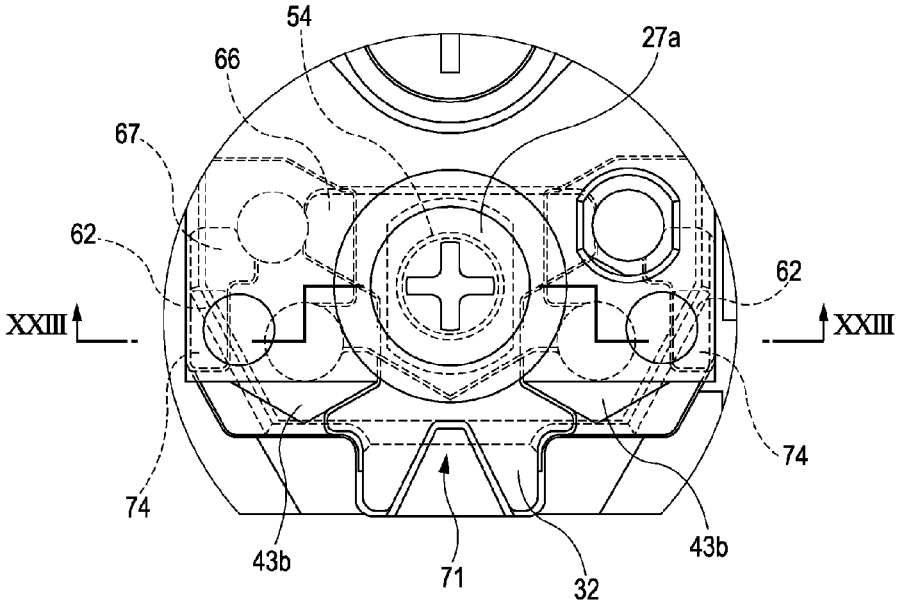
FIG. 22 is an enlarged view of a spacer fixing portion in a flange portion.
Figure 23:
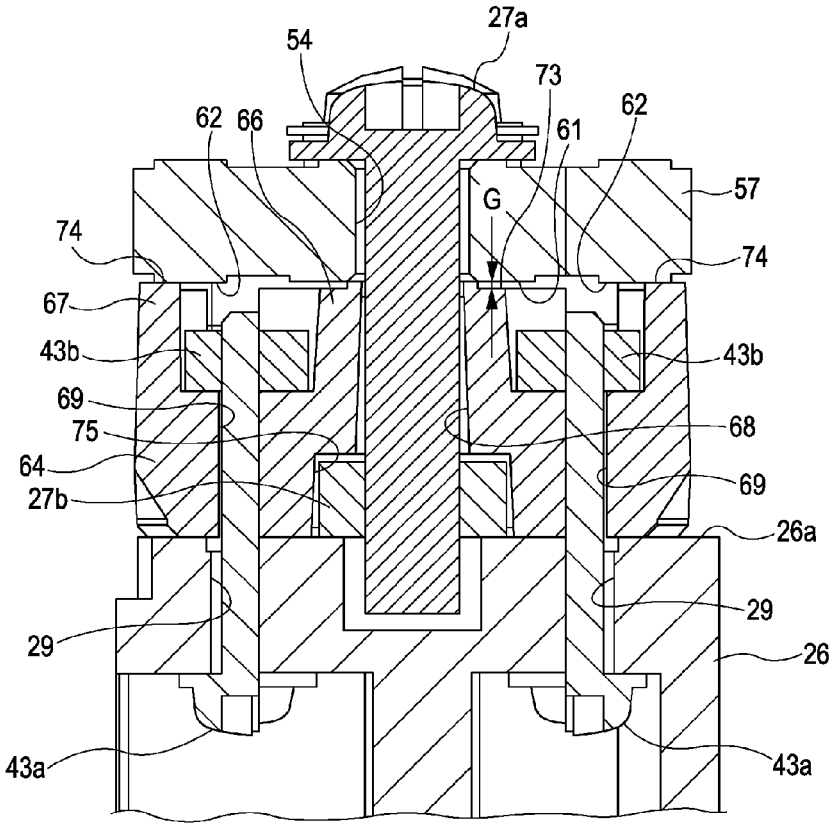
FIG. 23 is a cross-sectional view taken along the line XXIII-XXIII in FIG. 22.

FIG. 21A is a perspective view of the spacer 32 for explaining the configuration thereof, FIG. 21B is a top view of the spacer 32 for explaining the configuration thereof, FIG. 21C is a front view of the spacer 32 for explaining the configuration thereof, FIG. 21D is a right side view of the spacer 32 for explaining the configuration thereof, and FIG. 21E is a bottom view of the spacer 32 for explaining the configuration thereof. FIG. 22 is an enlarged plan view (enlarged view of an area XXII in FIG. 10) showing a position on the flange portion 57 where the spacer 32 is mounted, and FIG. 23 is a cross-sectional view taken along the line XXIII-XXIII in FIG. 22.

The spacer 32 in this embodiment is a member formed of synthetic resin, and one each of the spacers, two in total, is mounted on each of the spacer fixing surfaces 57*a* (the surfaces on the side of the sub tank 37) of the flange portions 57 on both sides for each of the recording heads 18. The spacer 32 roughly includes spacer body portions 64 each having a base surface 65 to be arranged on the base portion 26*a* of the sub carriage 26, a central protruding portion 66 formed on the spacer body portion 64 at the center portion in the width direction thereof (which corresponds to the flange width direction in a state of being mounted on the flange portion 57), and side wall portions 67 formed so as to be away from the central protruding portion 66 on both sides in the width direction. In the plan view, the dimension of the spacer 32 in the width direction generally matches the dimension of the flange portion 57 in the width direction. In a state in which the spacer 32 is correctly mounted on the flange portion 57, part (described later) of the central protruding portion 66 projects slightly sideward with respect to a projecting end surface of the flange portion 57.

The central protruding portion 66 protrudes from the spacer body portion 64 toward the direction of the flange portion 57 in the mounted state. Provided on side surfaces of the central protruding portion 66 on both sides in the width direction are notches conforming the shape of three sides of a head fixing nut 43*b* in plan view (see FIG. 22 and FIG. 23). The notches are head fixing nut notches 70 which restrict the posture of the head fixing nut 43*b* in the plan direction (that is, the rotation at the time of tightening) in cooperation with inner wall surfaces of the side wall portions 67. In other words, the head fixing nut receiving portions 72 which receive the head fixing nuts 43*b* are defined by the spacer body portion 64, the head fixing nut notches 70, and the side wall portions 67. Then, in a stage before the spacer 32 is fixed to the flange portion 57, the head fixing nuts 43*b* are fitted to the head fixing nut receiving portions 72, respectively (see FIGS. 24A and 24B).

A portion on one side of the central protruding portion 66 in the depth direction (the opposite side from the sub tank 37 in the state of being mounted on the flange portion 57) projects sideward from the spacer body portion 64. A jig notch 71 having a substantially triangular shape in plan view which is reduced gradually in width from one side to the other side in the depth direction is formed on this projecting portion. The jig notch 71 is configured to allow fitting of the jig for holding the head when positioning the recording head 18 to the head mounting portion of the sub carriage 26.

Formed at the center portion of the central protruding portion 66 in the width direction is the head insertion hole 68 (which corresponds to a second tightening member insertion port) corresponding to the spacer mounting hole 54 of the flange portion 57 of the recording head 18. The head insertion hole 68 is a through hole in a circular shape in plan view as shown in FIG. 21B. The inner diameter of the head insertion hole 68 is set to be slightly larger than the outer diameter of the shaft portion of the spacer fixing bolt 27*a* so as to match the inner diameter of the spacer mounting hole 54. The insertion hole limb portion 73 of the head insertion hole 68 projects toward the flange portion 57 with respect to the projecting end surface of the central protruding portion 66 in the mounted state. The insertion hole limb portion 73 is a bank-shaped projection surrounding the periphery of the opening of the head insertion hole 68 in plan view, and is provided at a position corresponding to the opening limb portion 61 of the flange portion 57.

The head fixing nut receiving portions 72 provided on both sides of the central protruding portion 66 are formed with sub carriage insertion holes 69 respectively corresponding to the securing holes 29 provided on the base portion 26*a* of the sub carriage 26. The sub carriage insertion holes 69 are circularshaped through holes in plan view as shown in FIG. 21B, and the inner diameter thereof is set to be slightly larger than the outer diameter of a shaft portion of a head fixing bolt 43*a*. Accordingly, the sub carriage insertion holes 69 allow smooth insertion of the shaft portions of the head fixing bolts 43*a* and, in addition, are configured so as not to cause rattling easily between the both members. In this manner, the one spacer 32 includes the one head insertion hole 68 and the two sub carriage insertion holes 69, respectively. In other words, the tightening point between the spacer 32 and the sub carriage 26 by the head fixing bolt 43*a* and the head fixing nut 43*b* are outsides of the tightening point between the spacer 32 and the flange portion 57 in the width direction. The head fixing bolt 43*a* and the head fixing nut 43*b* correspond to the head tightening members in the invention.

The side wall portions 67 provided respectively at the both end portions of the spacer 32 in the width direction are walls projecting from the spacer body portion 64 toward the flange portion 57 in the mounted state, and are formed continuously from both side surfaces of the spacer body portion 64 in the width direction. Projecting end surfaces of the side wall portions 67 are flush with a projecting end surface of the central protruding portion 66. The projecting end surfaces of the side wall portions 67 are formed with the abutting projections 74 (a kind of abutting protrusion) projecting from the end surfaces toward the flange portion 57 in the mounted state. The abutting projections 74 are provided at positions which can abut with the abutting protrusions 62 in a state in which the spacer 32 is mounted correctly to the flange portion 57 (in a state of being tightened by the spacer fixing bolt 27*a* and the spacer fixing nut 27*b*). Then, the amount of projection of the abutting projections 74 from the projecting end surfaces of the side wall portions 67 is set to be very slightly larger than the amount of projection of the insertion hole limb portions 73 from the projecting end surface of the central protruding portion 66. Accordingly, distal end surfaces of the abutting projections 74 come into abutment with distal end surfaces of the abutting protrusions 62 of the flange portion 57 and a distal end surface of the insertion hole limb portion 73 is slightly away from the distal end surfaces of the abutting protrusions 62 of the flange portion 57 in a state in which the spacer 32 is arranged on the flange portion 57 and before being tightened by the spacer fixing bolt 27*a* and the spacer fixing nut 27*b* (in a state in which the tightening force by the both members does not act on the spacer 32 and the flange portion 57). In this state, the gap G (see FIG. 23 and FIG. 24A) is generated at the tightening point between the spacer 32 and the flange portion 57 (the point to be tightened) by the spacer fixing bolt 27*a* and the spacer fixing nut 27*b*, that is, between the opening limb portion 61 of the spacer mounting hole 54 and the insertion hole limb portion 73 of the head insertion hole 68.

Formed at the center portion of the spacer 32 in the width direction on the side of the base surface 65 is a spacer fixing nut receiving portion 75. The spacer fixing nut receiving portion 75 is a depression conforming a part of the shape of the spacer fixing nut 27*b* in plan view, and is depressed from the base surface 65 to the midpoint of the spacer 32 in the thickness direction. In a state in which the spacer fixing nut 27*b* is fitted into the spacer fixing nut receiving portion 75 and is seated on the bottom portion of the depression, the posture of the spacer fixing nut 27*b* in the plan direction is restricted by an inner wall surface of the spacer fixing nut receiving portion 75. In other words, the rotation of the spacer fixing nut 27*b* at the time of tightening with respect to the spacer fixing bolt 27*a* is prevented. On a bottom portion of the depression of the spacer fixing nut receiving portion 75 is formed with the head insertion hole 68 opened therefrom. In addition, two adhesive agent injection ports 76 in total are formed between the central protruding portion 66 and the side wall portions 67 of the spacer 32 at positions deviated from the head fixing nut receiving portions 72 in the state of penetrating through the spacer 32 in the thickness direction. The adhesive agent injection ports 76 in this embodiment are through holes each having a circular shape in plan view. As described later, when provisionally fixing the recording head 18 to the base portion 26*a* of the sub carriage 26 in a state of being positioned, an adhesive agent is injected from the adhesive agent injection ports 76, and is filled in a gap between the base surface 65 of the spacer 32 and the base portion 26*a* of the sub carriage 26.

Subsequently, referring to FIGS. 24A and 24B and FIGS. 25A and 25B, a manufacturing step (assembly step) of the head unit 17 described above will be described.

Figure 24A:
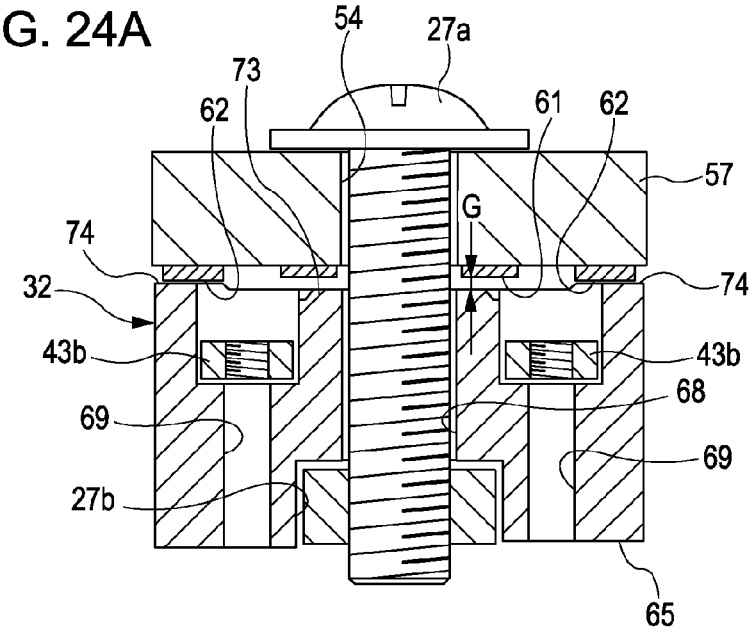
FIGS. 24A and 24B are cross-sectional views for explaining assembly steps of the head unit.
Figure 24B:
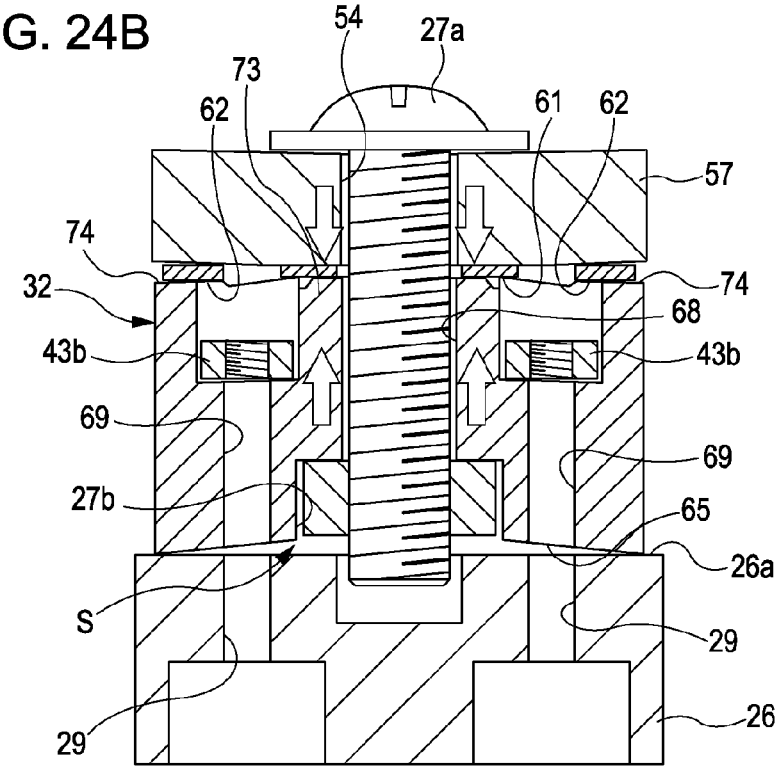

The spacers 32 configured as described above are tightened to the flange portions 57 on both sides of the recording head 18 in the stage before the recording head 18 is mounted on the sub carriage 26 respectively by the spacer fixing bolts 27*a* and the spacer fixing nuts 27*b* as shown in FIGS. 24A and 24B (spacer mounting step). The spacer fixing bolt 27*a* and the spacer fixing nut 27*b* are each a kind of the tightening member in the invention.

As described later, the spacer 32 is provisionally fixed to the sub carriage 26 with the adhesive agent, and then is really fixed by the head fixing bolt 43*a* and the head fixing nut 43*b*. The recording head 18 fixed once to the sub carriage 26 can be removed from the spacer 32 and the sub carriage 26 by releasing tightening with respect to the spacer 32 by the spacer fixing bolt 27*a* and the spacer fixing nut 27*b*. Accordingly, mounting and demounting of the recording head 18 for replacement, repair, or the like of the recording head 18 is facilitated.

Here, as described above, in a state in which the spacer 32 is arranged on the flange portion 57, and before tightening by the spacer fixing bolt 27*a* and the spacer fixing nut 27*b*, the abutting protrusions 62 and the abutting projections 74 come into abutment with each other at both end portions which are positioned as far as possible from the tightening point in the flange width direction, and on the other hand, the gap G is generated at the tightening point (the point to be tightened) between the spacer 32 and the flange portion 57, that is, between the opening limb portion 61 of the spacer mounting hole 54 and the insertion hole limb portion 73 of the head insertion hole 68. Accordingly, in a state after the spacer 32 is tightened to the flange portion 57 by the spacer fixing bolt 27*a* and the spacer fixing nut 27*b*, the abutting protrusions 62 and the abutting projections 74 come into abutment with each other preferentially over other portions in comparison with the tightening point between the spacer 32 and the flange portion 57 and the tightening point between the spacer 32 and the sub carriage 26 on the outside in the flange width direction. By the abutment between the abutting protrusions 62 and the abutting projections 74, the position in the height direction and the posture of the spacer 32 with respect to the flange portion 57 are restricted. With the employment of the configuration as described above, generation of inclination between the recording head 18 and the spacer 32 in the direction orthogonal to the imaginary line connecting the tightening points of the flange portion 57 on both sides, that is, in this embodiment, in the short side direction of the recording head 18 is restrained. Therefore, even in a state in which the recording head 18 is mounted on the sub carriage 26 with the intermediary of the spacer 32, the recording head 18 is restrained from being inclined with respect to the sub carriage 26 in the short side direction.

Incidentally, as shown in FIG. 24A, the gap G generated between the opening limb portion 61 of the spacer mounting hole 54 and the insertion hole limb portion 73 of the head insertion hole 68 is preferably as small as possible in a state in which the spacer 32 is set on the flange portion 57 and before tightening the both members. Ideally, the abutting surface between the opening limb portion 61 and the insertion hole limb portion 73 and the abutting surfaces between the abutting protrusions 62 and the abutting projections 74 are flush with each other. However, as described above, further steady abutment between the abutting protrusions 62 and the abutting projections 74 get preference in order to restrain the inclination of the recording head 18 in the short side direction (the direction orthogonal to the imaginary line connecting the tightening points with respect to the spacer 32 on the flange portions 57 on both sides) and, actually, it is necessary to design so that the gap G is generated slightly therebetween considering the dimensional tolerance. When tightening the spacer 32 to the flange portion 57 by the spacer fixing bolt 27*a* and the spacer fixing nut 27*b* in a state in which the gap G as described above is generated, a portion clamped mainly by a head portion of the spacer fixing bolt 27*a* and the spacer fixing nut 27*b* is deformed and curved so as to approach each other by the tightening force as shown by arrows in FIG. 24B as the spacer fixing bolt 27*a* and the spacer fixing nut 27*b* are tightened. Accordingly, the opening limb portion 61 of the flange portion 57 and the head insertion hole 68 of the spacer 32 gradually approach, and finally come into abutment with each other. Then, when the recording head 18 in a state in which the spacer 32 is tightened is set to the head mounting portion of the base portion 26*a* of the sub carriage 26, a gap S is generated between the base surface 65 of the spacer 32 and the base portion 26*a* of the sub carriage 26. In FIG. 24B, the above-described deformation is exaggerated for the sake of easy understanding.

When the spacers 32 are fixed to the flange portions 57 on both sides of the recording head 18 respectively, then, positioning of the recording head 18 with respect to the head mounting portion of the sub carriage 26 is performed (positioning step). In this positioning step, for example, the position of the recording head 18 on the base portion 26*a* is adjusted so that a predetermined number (plural, at least two) of specific nozzles 51 on the nozzle forming surface 53 are positioned at prescribed positions while observing the nozzle forming surface 53 of the recording head 18 set to the head mounting portion on the base portion 26*a* of the sub carriage 26 using an imaging device such as a CCD camera. When the recording head 18 to be mounted is positioned, then, the spacer 32 mounted on the recording head 18 is provisionally fixed to the base portion 26*a* with adhesive agent (provisionally fixing step). As the adhesive agent used for the provisional fixation, so-called instant adhesive containing cyanoacrylate as a chief component is preferable. However, arbitrary adhesive agent may be used as long as the rigidity which achieves fixation of the recording head 18 with respect to the sub carriage 26 without rattling in a state of being completely cured. For example, UV-cured adhesive agent may also be employed. In this case, the spacer 32 or the sub carriage 26 is preferably formed of translucent material.

Here, in the provisionally fixing step in the related art, since the fixation with the adhesive agent is simply performed for the sake of convenience so as to prevent positional displacement at the time of real fixation, only a small amount of adhesive agent is injected between the spacer 32 and the base portion 26*a*. Therefore, when the provisionally fixing step and the really fixing step are employed in this embodiment as-is, the real fixation by the head fixing bolt 43*a* and the head fixing nut 43*b* is performed in a state in which the gap S is generated between the base portion 26*a* of the sub carriage 26 and the base surface 65 of the spacer 32. In this case, as the head fixing bolt 43*a* and the head fixing nut 43*b* are tightened, the portion clamped between a head portion of the head fixing bolt 43*a* and the head fixing nut 43*b* is deformed so as to approach each other in a range of the gap S by the tightening force, so that the base portion 26*a* and the base surface 65 are finally brought into abutment with each other. In other words, the gap S caused by the deformation generated when tightening the spacer 32 to the flange portion 57 by the spacer fixing bolt 27*a* and the spacer fixing nut 27*b* serves as a deformation margin, and the corresponding portion is deformed by the tightening force applied when tightening by the head fixing bolt 43*a* and the head fixing nut 43*b* to restore the original state. In this process, the positional accuracy of the recording head 18 on the sub carriage 26 may be lowered by the displacement of the position of the recording head 18.

Figure 25A:
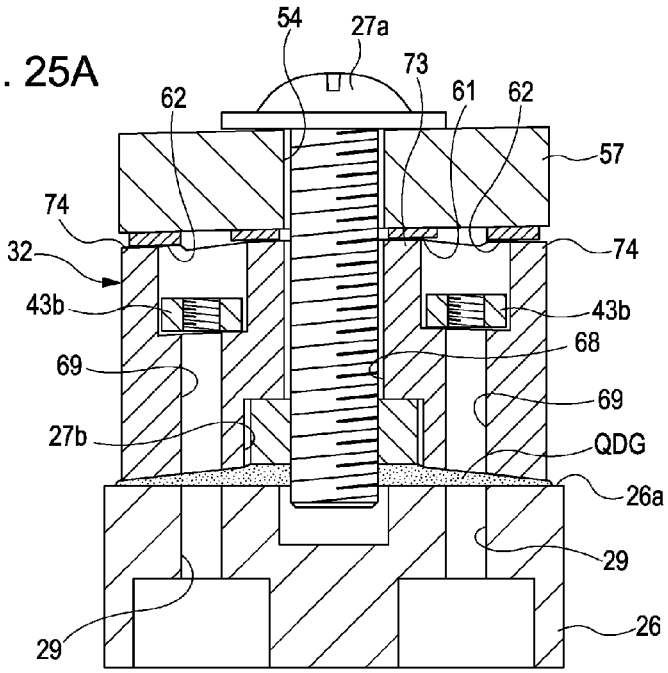
FIGS. 25A and 25B are cross-sectional views for explaining the assembly steps of the head unit.
Figure 25B:
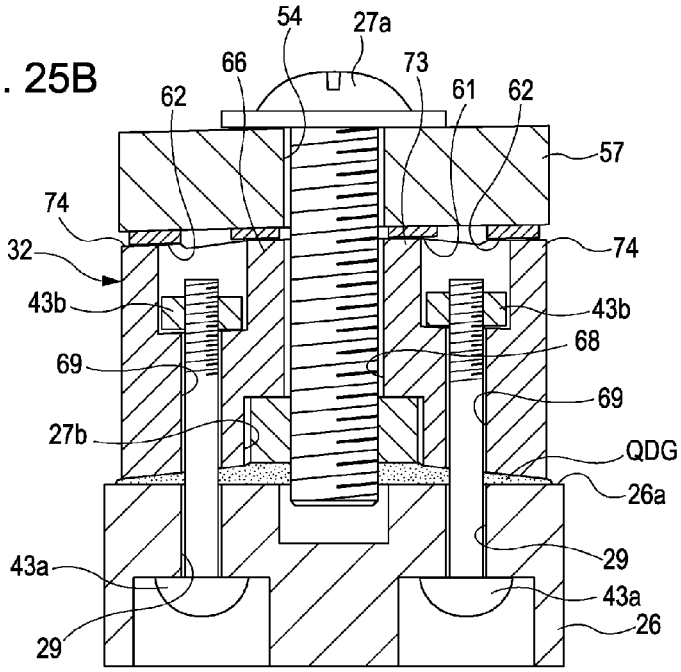

In contrast, in the provisionally fixing step in this embodiment, as shown in FIG. 25A, the adhesive agent (shown in QDG in the drawing) is injected between the spacer 32 and the base portion 26*a* by a larger amount than in the related art to an extent that the gap S is almost filled with the adhesive agent. More specifically, in a state in which the recording head 18 is positioned with respect to the base portion 26*a*, the adhesive agent is injected from the adhesive agent injection ports 76 of the spacer 32 using a dispenser such as micro syringe. The adhesive agent injected from the adhesive agent injection ports 76 is spread all over between the spacer 32 and the base portion 26*a* are tightened by a capillary action and is filled in the gap S. Then, after the adhesive agent is cured, as shown in FIG. 25B, the spacer 32 and the base portion 26*a* by the head fixing bolt 43*a* and the head fixing nut 43*b*, and the first recording head 18*a* is really fixed to the prescribed position on the base portion 26*a* (really fixing step). In this case, as described above, since the adhesive agent filled in the gap S between the base surface 65 of the spacer 32 and the base portion 26*a* of the sub carriage 26 is cured, even when the tightening force at the time of tightening by the head fixing bolt 43*a* and the head fixing nut 43*b* is applied, the deformation margin is not present. Therefore, deformation of the spacer 32 and other components is restrained. Accordingly, the position of the recording head 18 with respect to the sub carriage 26 is prevented from being displaced. Consequently, both the prevention of inclination of the recording head 18 with respect to the sub carriage 26 and the securement of the positional accuracy can be established simultaneously.

As in this embodiment, since the flange portion 57 is formed with the opening limb portion 61 of the spacer mounting hole 54 and the abutting protrusions 62 so as to project therefrom, and the spacer 32 is formed with the insertion hole limb portion 73 of the head insertion hole 68 and the abutting projections 74 so as to project therefrom, the dimensions (the amounts of projection) of the respective portions can easily be distributed when molding these portions with a mold. Accordingly, the gap G generated between the opening limb portion 61 of the spacer mounting hole 54 and the insertion hole limb portion 73 of the head insertion hole 68 can be minimized. Consequently, the deformation of the spacer 32 and other components by the tightening force at the time of tightening can be restrained as much as possible, so that the mounting accuracy of the recording head 18 with respect to the sub carriage 26 can be improved.

Also, since the tightening point between the spacer 32 and the sub carriage 26 is provided outside of the tightening point between the flange portion 57 and the spacer 32 in the width direction (the flange width direction) and the abutting protrusions 62 and the abutting projections 74 are provided outside of the tightening point between the spacer 32 and the sub carriage 26 in the width direction, the abutting protrusions 62 and the abutting projections 74 come into abutment on the outside of the respective tightening points in the width direction. Accordingly, generation of inclination between the flange portion 57 and the spacer 32 is further reliably restrained.

Then, in the same procedure, the respective recording heads 18 are mounted on the sub carriage 26. Then, the flow channel member 24 is fixed to the sub carriage 26 (flow channel mounting step). As described above, the flow channel member 24 is fixed to the sub carriage 26 with the flow channel securing screws 45. In this case, the connecting channels of the flow channel member 24 are inserted respectively into the flow channel connecting portions 38 of the sub tanks 37 of the respective recording heads 18 and coupled thereto in a liquid-tight manner. The flow channel member 24 may be fixed to the sub carriage 26 in a step before the respective recording heads 18 are mounted on the sub carriage 26.

The head unit 17 is completed via the steps described above. The head unit 17 is received in the interior of the carriage body 12 in a state in which the nozzle forming surfaces 53 of the respective recording heads 18 are exposed from the bottom opening 19 of the bottom plate portion 12*a* of the carriage body 12, is adjusted in posture of the head unit 17 with respect to the carriage body 12 such as the position or the inclination, and then is fixed by screwing the head unit fixing screws 22.

The invention is not limited to the embodiments described above, and various modifications may be made on the basis of description of claims.

For example, the shape of the sub carriage 26 as the head fixing member is not limited to the box-shape opening on top as exemplified in the respective embodiments described above. The invention may be applied to any types of head fixing member as long as the base portion 26*a* on which the recording heads 18 is mounted is provided and the recording heads 18 are fixed with the intermediary of the spacers as the intermediate members. The configuration or the number of the recording heads 18 to be mounted on the sub carriage 26 are not limited to those shown in the embodiment described above.

In the embodiments described above, the configuration in which the flange portion 57 as the intermediate member fixing portion is formed with the abutting protrusions 62 on the side of the spacer 32 in the mounted state so as to project therefrom, and the spacer 32 as the intermediate member is formed with the abutting projections 74 (a kind of the abutting projection) on the side of the flange portion 57 in the mounted state so as to project therefrom, that is, the configuration in which the abutting protrusions are provided on both of the flange portion 57 and the spacer 32 is shown as an example. However, the invention is not limited thereto. What is essential is that a plurality of the abutting projections are formed on at least one of the flange portion 57 and the spacer 32, and at least two of the plurality of abutting protrusions are provided on the outside of the tightening point by the tightening member (the spacer fixing bolt 27*a* and the spacer fixing nut 27*b*) in the width direction orthogonal to the imaginary line connecting the tightening points of the flange portions 57 on both sides, the gap G is formed between the flange portion 57 and the spacer 32 at the tightening points (the opening limb portion 61 of the spacer mounting hole 54 and the insertion hole limb portion 73 of the head insertion hole 68) before being tightened by the tightening members in a state in which the respective abutting protrusions abut against the other, while the flange portion 57 and the spacer 32 come into abutment with each other at the tightening point after having tightened. When three or more abutting protrusions are provided on the flange portion 57 or the spacer 32, as long as two of them are provided on the outside of the tightening point tightened by the tightening members in the width direction, remaining abutting protrusions may be provided at arbitrary positions which do not interfere with other portions.

In addition, in the respective embodiments described above, the configuration in which the ink is ejected while reciprocating the recording heads 18 with respect to the recording medium has been described as an example. However, the invention is not limited thereto. For example, a configuration in which ink is ejected while moving the recording medium with respect to the recording heads 18 in a state in which the positions of the recording heads 18 are fixed can also be employed.

In the description given below, the ink jet printer 1, which is a kind of the liquid ejecting apparatus, has been exemplified for description, the invention can be applied to other liquid ejecting apparatuses having the configuration in which the liquid ejecting head is fixed with the intermediate member is interposed with respect to the head fixing member. For example, the invention can be applied to display manufacturing apparatuses configured to manufacture color filters such as liquid crystal displays, electrode manufacturing apparatuses configured to form electrodes such as organic electro luminescence displays, and FED (surface emitting display), chip manufacturing apparatuses configured to manufacture biochips (biochemical elements), and micro pipette configured to supply a very small amount of sample solution by an accurate amount.

What is claimed is:

1. A liquid ejecting head unit comprising:

a liquid ejecting head having a nozzle forming surface in which a nozzle row made up of a plurality of nozzles that eject liquid is formed; and a head fixing member on which the liquid ejecting head is fixed with intermediate members provided therebetween, wherein the liquid ejecting head includes intermediate member fixing portions to which the intermediate members are anchored and abutted thereto by tightening members, the intermediate member fixing portions being positioned at both ends of the liquid ejecting head with the intermediate members mounted thereto such that a head body of the liquid ejecting head is in between the intermediate member fixing portions, the intermediate member fixing portion and the intermediate member fixed thereto is formed with a plurality of abutting protrusions projecting to a side where the intermediate member abuts the intermediate member fixing portion, at least two of the plurality of abutting protrusions on one side of the liquid ejecting head are provided on the outside of a tightening point, tightened by the tightening members, in the width direction orthogonal to an imaginary line connecting the tightening points on both sides of the liquid ejecting head through the liquid ejecting head, and a gap is formed between the intermediate member fixing portion and the intermediate member at the tightening point before being tightened by the tightening member, while the intermediate member fixing portion and the intermediate member come into abutment with each other at the tightening point after having tightened by the tightening member in a state in which the respective abutting protrusions abut against the other, wherein the intermediate member fixing portion and the intermediate member are anchored by the tightening member, and the intermediate member and the head fixing member are anchored by a head tightening member disposed outside the tightening member in the width direction orthogonal to the imaginary line, the tightening member and the head tightening member extending parallel to each other.

2. The liquid ejecting head unit according to claim 1, wherein the intermediate member fixing portion and the intermediate member are anchored by the tightening member, and the intermediate member and the head fixing member are anchored by the head tightening member in a state in which adhesive agent filled without formation of a gap between a surface of the intermediate member opposite from a surface opposing the intermediate member fixing portion and a head fixing surface of the head fixing member is cured.

3. The liquid ejecting head unit according to claim 1, wherein a first tightening member insertion port which allows insertion of the tightening member is formed at a center portion of the respective intermediate member fixing portions in the width direction, while a second tightening member insertion port is formed on the intermediate member at a position corresponding to the first tightening member insertion port, and a gap is formed between an opening limb portion of the first tightening member and an opening limb portion of the second tightening member insertion port before being tightened by the tightening member, and the opening limb portion of the first tightening member insertion port and the opening limb portion of the second tightening member insertion port are in abutment with each other after having tightened by the tightening member in a state in which the respective abutting protrusions are in abutment with the other.

4. The liquid ejecting head unit according to claim 1, wherein the tightening point between the intermediate member and the head fixing member is provided on the outside of the tightening point between the intermediate member fixing portion and the intermediate member in the width direction and the abutting protrusions are provided on the outside of the tightening point between the intermediate member and the head fixing member in the width direction.

5. A liquid ejecting apparatus comprising:

a liquid ejecting head unit including a liquid ejecting head having:

a liquid ejecting head having a nozzle forming surface in which a nozzle row made up of a plurality of nozzles that eject liquid is formed; and a head fixing member on which the liquid ejecting head is fixed with intermediate members provided therebetween, wherein the liquid ejecting head includes intermediate member fixing portions to which the intermediate members are anchored and abutted thereto by tightening members, the intermediate member fixing portions being positioned at both ends of the liquid ejecting head with the intermediate members mounted thereto such that a head body of the liquid ejecting head is in between the intermediate member fixing portions, the intermediate member fixing portion and the intermediate member fixed thereto is formed with a plurality of abutting protrusions projecting to a side where the intermediate member abuts the intermediate member fixing portion, at least two of the plurality of abutting protrusions on one side of the liquid ejecting head are provided on the outside of a tightening point, tightened by the tightening members, in the width direction orthogonal to an imaginary line connecting the tightening points on both sides of the liquid ejecting head through the liquid ejecting head, and a gap is formed between the intermediate member fixing portion and the intermediate member at the tightening point before being tightened by the tightening member, while the intermediate member fixing portion and the intermediate member come into abutment with each other at the tightening point after having tightened by the tightening member in a state in which the respective abutting protrusions abut against the other, wherein the intermediate member fixing portion and the intermediate member are anchored by the tightening member, and the intermediate member and the head fixing member are anchored by a head tightening member disposed outside the tightening member in the width direction orthogonal to the imaginary line, the tightening member and the head tightening member extending parallel to each other.

6. The liquid ejecting head unit according to claim 1, wherein a first portion clamped by a first tightening member and a second portion clamped by a second tightening member are curved so as to approach each other by a tightening force.

7. The liquid ejecting head unit according to claim 1, wherein the abutting protrusions are formed to protrude in a direction in which the intermediate member fixing portion and the intermediary member abut.

* * * * *